US008579507B2

(12) United States Patent
Holmes et al.

(10) Patent No.: US 8,579,507 B2
(45) Date of Patent: Nov. 12, 2013

(54) REINFORCED BAG

(75) Inventors: Gabriele R. Holmes, Gladstone, OR (US); Darrel L. Wilhoit, Washougal, WA (US); John C. Files, Vancouver, WA (US)

(73) Assignee: Graphic Flexible Packaging, LLC, Atlanta, GA (US)

( * ) Notice: Subject to any disclaimer, the term of this patent is extended or adjusted under 35 U.S.C. 154(b) by 358 days.

(21) Appl. No.: 12/870,209

(22) Filed: Aug. 27, 2010

(65) Prior Publication Data

US 2011/0052106 A1 Mar. 3, 2011

Related U.S. Application Data

(60) Provisional application No. 61/237,446, filed on Aug. 27, 2009, provisional application No. 61/396,115, filed on May 21, 2010.

(51) Int. Cl.

| | |
|---|---|
| ***B65D 33/02*** | (2006.01) |
| ***B65D 30/08*** | (2006.01) |
| ***B65D 30/10*** | (2006.01) |

(52) U.S. Cl.

USPC ..... 383/119; 383/109; 383/123

(58) Field of Classification Search

USPC ..... 383/119, 109, 123, 124

See application file for complete search history.

(56) References Cited

U.S. PATENT DOCUMENTS

| | | | | |
|---|---|---|---|---|
| 1,719,405 | A | | 7/1929 | Townsend |
| 1,833,675 | A | | 4/1931 | Geimer |
| 1,834,419 | A | * | 12/1931 | Pratt ..... 206/5 |
| 1,868,069 | A | * | 7/1932 | Munson ..... 383/106 |
| 1,995,286 | A | | 3/1935 | Arzet |
| 2,041,227 | A | | 5/1936 | Chalmers |
| 2,161,071 | A | | 6/1939 | McGrath et al. |
| 2,255,975 | A | | 9/1941 | Hultkrans |
| 2,260,064 | A | * | 10/1941 | Stokes ..... 53/415 |

(Continued)

FOREIGN PATENT DOCUMENTS

| | | |
|---|---|---|
| AU | 126602 | 12/1944 |
| AU | 51656 | 9/1970 |

(Continued)

OTHER PUBLICATIONS

International Search Report and Written Opinion dated May 18, 2011 for PCT/US2010/046950.

(Continued)

*Primary Examiner* — Jes F Pascua

(74) *Attorney, Agent, or Firm* — Womble Carlyle Sandridge & Rice, LLP

(57) ABSTRACT

A bag has a reinforcement that is configured in a predetermined manner for reinforcing at least a portion of the bag. One or more predetermined areas of the bag may be reinforced. The bag may have one or more layers, and may be reinforced by placing and affixing reinforcing media in selected areas. The nature of the reinforcing media—its dimensions and structural properties—may be selected with respect to targeted uses of the bag. The bag may be subjected to one or more types of potentially failure-causing strain (e.g. bending, twisting, puncture, tensile, compression) during the useful life of the bag. For example, the bag may be stressed during filling the bag with product, top sealing, conveying by hand or machine, loading and stacking, transportation, storage, selling and final use by the consumer.

27 Claims, 18 Drawing Sheets

(56) References Cited

U.S. PATENT DOCUMENTS

| | | | | | |
|---|---|---|---|---|---|
| 2,330,015 | A | * | 9/1943 | Stokes | 383/109 |
| 2,396,565 | A | | 3/1946 | Gardner | |
| 2,582,286 | A | | 1/1952 | Schenck | |
| 2,766,926 | A | * | 10/1956 | Thompson | 383/98 |
| 2,833,094 | A | | 5/1958 | Moore | |
| 2,854,186 | A | * | 9/1958 | Williams | 383/109 |
| 2,869,772 | A | * | 1/1959 | Williams | 383/114 |
| 2,892,580 | A | * | 6/1959 | Williams | 383/98 |
| 2,948,457 | A | | 8/1960 | Thiele | |
| 2,957,394 | A | * | 10/1960 | Williams | 493/220 |
| 3,051,103 | A | * | 8/1962 | Williams | 156/93 |
| 3,185,384 | A | | 5/1965 | Ragan et al. | |
| 3,237,844 | A | | 3/1966 | Hughes | |
| 3,249,286 | A | | 5/1966 | Palmer | |
| 3,306,522 | A | | 2/1967 | Honsel | |
| 3,372,859 | A | | 3/1968 | Bjorkengren et al. | |
| 3,437,258 | A | | 4/1969 | Kugler | |
| 3,485,438 | A | | 12/1969 | McCall et al. | |
| 3,568,918 | A | * | 3/1971 | Blomqvist | 383/109 |
| 3,599,539 | A | | 8/1971 | Coverstone et al. | |
| 3,682,372 | A | | 8/1972 | Rodley | |
| 3,719,318 | A | | 3/1973 | Moran | |
| 3,807,626 | A | | 4/1974 | Goodrich | |
| 3,850,724 | A | * | 11/1974 | Lehmacher | 156/201 |
| 3,851,574 | A | | 12/1974 | Katz et al. | |
| 3,896,991 | A | | 7/1975 | Kozlowski et al. | |
| 3,929,275 | A | | 12/1975 | Bolling et al. | |
| 3,935,993 | A | | 2/1976 | Doyen et al. | |
| 3,958,749 | A | | 5/1976 | Goodrich | |
| 3,970,241 | A | | 7/1976 | Hanson | |
| 4,014,252 | A | * | 3/1977 | Saito | 493/217 |
| 4,082,216 | A | | 4/1978 | Clarke | |
| 4,096,987 | A | | 6/1978 | Rodish | |
| 4,121,757 | A | | 10/1978 | Hamlin | |
| 4,243,171 | A | | 1/1981 | Prin | |
| 4,260,061 | A | | 4/1981 | Jacobs | |
| 4,301,961 | A | | 11/1981 | Rodish | |
| 4,353,497 | A | | 10/1982 | Bustin | |
| 4,450,180 | A | | 5/1984 | Watkins | |
| 4,450,581 | A | | 5/1984 | Hirata | |
| 4,479,243 | A | | 10/1984 | Derby et al. | |
| 4,521,910 | A | * | 6/1985 | Keppel et al. | 383/10 |
| 4,548,826 | A | | 10/1985 | Watkins | |
| 4,576,844 | A | | 3/1986 | Murray et al. | |
| 4,672,684 | A | | 6/1987 | Barnes et al. | |
| 4,674,129 | A | | 6/1987 | Janhonen | |
| 4,677,007 | A | | 6/1987 | Murray | |
| 4,681,781 | A | | 7/1987 | Murray et al. | |
| 4,691,368 | A | | 9/1987 | Roessiger | |
| 4,691,374 | A | | 9/1987 | Watkins et al. | |
| 4,738,546 | A | * | 4/1988 | Sengewald | 383/7 |
| 4,781,475 | A | | 11/1988 | LaFleur | |
| 4,783,178 | A | | 11/1988 | Herder | |
| 4,849,040 | A | | 7/1989 | Wood | |
| 5,044,777 | A | | 9/1991 | Watkins et al. | |
| 5,060,850 | A | | 10/1991 | Weaver | |
| 5,165,799 | A | | 11/1992 | Wood | |
| 5,195,829 | A | | 3/1993 | Watkins et al. | |
| 5,326,576 | A | | 7/1994 | Zuege | |
| 5,474,383 | A | | 12/1995 | Zuege et al. | |
| 5,618,254 | A | | 4/1997 | Derby | |
| 5,644,900 | A | | 7/1997 | Steele et al. | |
| 5,716,138 | A | | 2/1998 | Southwell | |
| 5,718,514 | A | | 2/1998 | Steele et al. | |
| 5,759,144 | A | | 6/1998 | Derby | |
| 5,984,850 | A | | 11/1999 | Derby | |
| 6,599,016 | B1 | | 7/2003 | Culbertson et al. | |
| 6,800,051 | B2 | | 10/2004 | Koehn | |
| 7,316,839 | B2 | | 1/2008 | Knauf | |
| 7,819,583 | B2 | | 10/2010 | Walker et al. | |
| 2004/0105600 | A1 | * | 6/2004 | Floyd, Jr. | 383/109 |
| 2007/0000568 | A1 | | 1/2007 | Bohme et al. | |
| 2007/0104397 | A1 | | 5/2007 | Walker et al. | |
| 2007/0292569 | A1 | | 12/2007 | Bohme et al. | |
| 2009/0123093 | A1 | * | 5/2009 | Lemoyne et al. | 383/99 |
| 2009/0263048 | A1 | | 10/2009 | Iannelli, II et al. | |
| 2009/0263049 | A1 | | 10/2009 | Iannelli, II et al. | |
| 2010/0263332 | A1 | | 10/2010 | Files et al. | |
| 2010/0270309 | A1 | | 10/2010 | Files et al. | |
| 2010/0273017 | A1 | | 10/2010 | Files | |
| 2010/0273377 | A1 | | 10/2010 | Files et al. | |

FOREIGN PATENT DOCUMENTS

| | | | |
|---|---|---|---|
| DK | 81544 | | 12/1956 |
| EP | 0 283 279 | A2 | 9/1988 |
| EP | 0 172 179 | B1 | 9/1990 |
| GB | 660 889 | | 11/1951 |
| JP | 50-146908 | | 12/1975 |
| JP | 52-30306 | | 3/1977 |
| JP | 10-152179 | A | 6/1998 |
| NL | 23252 | | 11/1930 |

OTHER PUBLICATIONS

International Organization for Standardization, ISO 6590/1, "Packaging—Sacks—Vocabulary and Types—Part 1: Paper Sacks", 1983, pp. 6-8.

"Bag Making Adhesives, a professional guide", National Adhesives, National Starch and Chemical Corporation, 1971.

Wiley Encyclopedia of Packaging Technology, 1986, pp. 14-16.

"AMV 2170—Vertical Stepped-End Tubing Machine" Brochure, before Feb. 1994.

"Paper Sacks—A Users Guide", Finch Partnership Limited, Liverpool, England, 1973.

"The Combined Paper—Plastic Sack", Converter, Nov. 1973, pp. 14-16.

New Zealand Patent Office Journal No. 1372, Isssued on Sep. 27, 1993, col. 82, Issue No. 8, p. 1199.

* cited by examiner

REINFORCED BAG

CROSS-REFERENCE TO RELATED APPLICATIONS

The present application claims the benefit of U.S. Provisional Application Nos. 61/237,446 and 61/396,115 filed Aug. 27, 2009, and May 21, 2010, respectively.

TECHNICAL FIELD

The present disclosure generally relates to bags and, more particularly, to composite or reinforced bags.

BACKGROUND

Bags, such paper bags or bags constructed of other flexible media, are widely used in numerous applications. Because of the rigors and strains to which bags are exposed in use, there has been a need to reinforce bags to prevent failure and loss of the contents of the bags. Whereas reinforced bags are known, there is always a desire for improvements.

BRIEF SUMMARY OF SOME ASPECTS OF THIS DISCLOSURE

According to one aspect of this disclosure, prior to making a bag, the intended use of the bag may be analyzed to identify a first area of the bag that may be exposed to higher stress than a second area of the bag. The bag may be made from a sheet. A first area of the sheet may include reinforcing media, and reinforcing media may be absent from a second area of the sheet. The bag may be made from the sheet so that the first area of the bag comprises the first area of the sheet, which includes the reinforcing media, and the second area of the bag comprises the second area of the sheet, which is absent of reinforcing media. Alternatively, the entire bag may be reinforced. The bag may be made by forming a substantially tubular structure from the sheet, and then closing an end of the tubular structure.

Also, the manner in which the bag is intended to perform may be analyzed. The strength of the reinforcing media and/or other criteria regarding the reinforcing media may be selected in view of this analysis.

In accordance with one aspect of this disclosure, a bag has a reinforcement that is configured in a predetermined manner for reinforcing at least a portion of the bag. For example, one or more predetermined areas of the bag may be reinforced while one or more other predetermined areas of the bag are not reinforced. The bag may have one or more layers (e.g., ply(s)), and may be reinforced by placing and affixing reinforcing media in selected areas. The reinforcing seeks to improve the value of the bag. The nature of the reinforcing media—its dimensions and structural properties—may be selected with respect to targeted uses of the bag. Regarding the targeted uses of the bag, the bag may be subjected to one or more types of potentially failure-causing strain (e.g. bending, twisting, puncture, tensile, compression etc.) during the useful life of the bag. For example, the bag may be stressed during filling the bag with product, top sealing, conveying by hand or machine, loading and stacking on a pallet (or other carrying devices), transportation, storage, selling and final use by the consumer.

The sheet may be manufactured on a continuous manufacturing line. For example, a web of material may be drawn in a downstream direction, and reinforcing media may be mounted to a predetermined portion of the web.

Aspects of this disclosure seek to enable a designer and manufacturer to 1) use any application-suitable reinforcing media to get the targeted final bag performance, 2) reinforce only the area(s) of strain vulnerability and 3) introduce the reinforcing media onto a sheet (e.g., web) on a continuous, relatively high-speed manufacturing line before the sheet is converted into bag form.

In accordance with one aspect of this disclosure, a composite bag (e.g., a multiwall bag and/or a reinforced bag) has opposite ends that are spaced apart from one another in a longitudinal direction, a plurality of walls that extend around the interior space of the composite bag, and a reinforcement (e.g., a reinforcing insert, sheet, ply and/or erected structure) that is reinforcing at least a portion of a wall of the plurality of walls, wherein the reinforcement may not completely circumscribe the interior space of the composite bag. In a more specific example, the reinforcement may not completely circumscribe the longitudinal axis of interior space of the composite bag. A gap may be defined between the opposite ends of the reinforcement. The gap may aid in insertion of the reinforcement, if the reinforcement is of a type that is inserted into a bag.

According to one aspect of this disclosure, a composite bag (e.g., a multiwall bag) has opposite first and second ends that are each closed, and a plurality of plies that extends around an interior of the bag, wherein the plurality of plies includes a first ply (e.g., a reinforcing ply, such as a reinforcing sheet) that extends substantially into the first close end, and the first ply is substantially absent from the second closed end.

In one example, one or more predetermined areas of a bag may be reinforced while one or more other predetermined areas of the bag are not reinforced. For example, a bag comprising Kraft paper may be partially reinforced by a paperboard reinforcement that is arranged in a predetermined manner. As another example, a bag comprising Kraft paper may include paperboard reinforcements that are spaced apart from one another and may be arranged in series with respect to one another.

Other aspects and advantages of this disclosure will become apparent from the following.

BRIEF DESCRIPTION OF THE DRAWINGS

Having described some aspects of the invention in general terms, reference will now be made to the accompanying drawings, which are schematic and not necessarily drawn to scale, and wherein.

DETAILED DESCRIPTION

Figure 1:
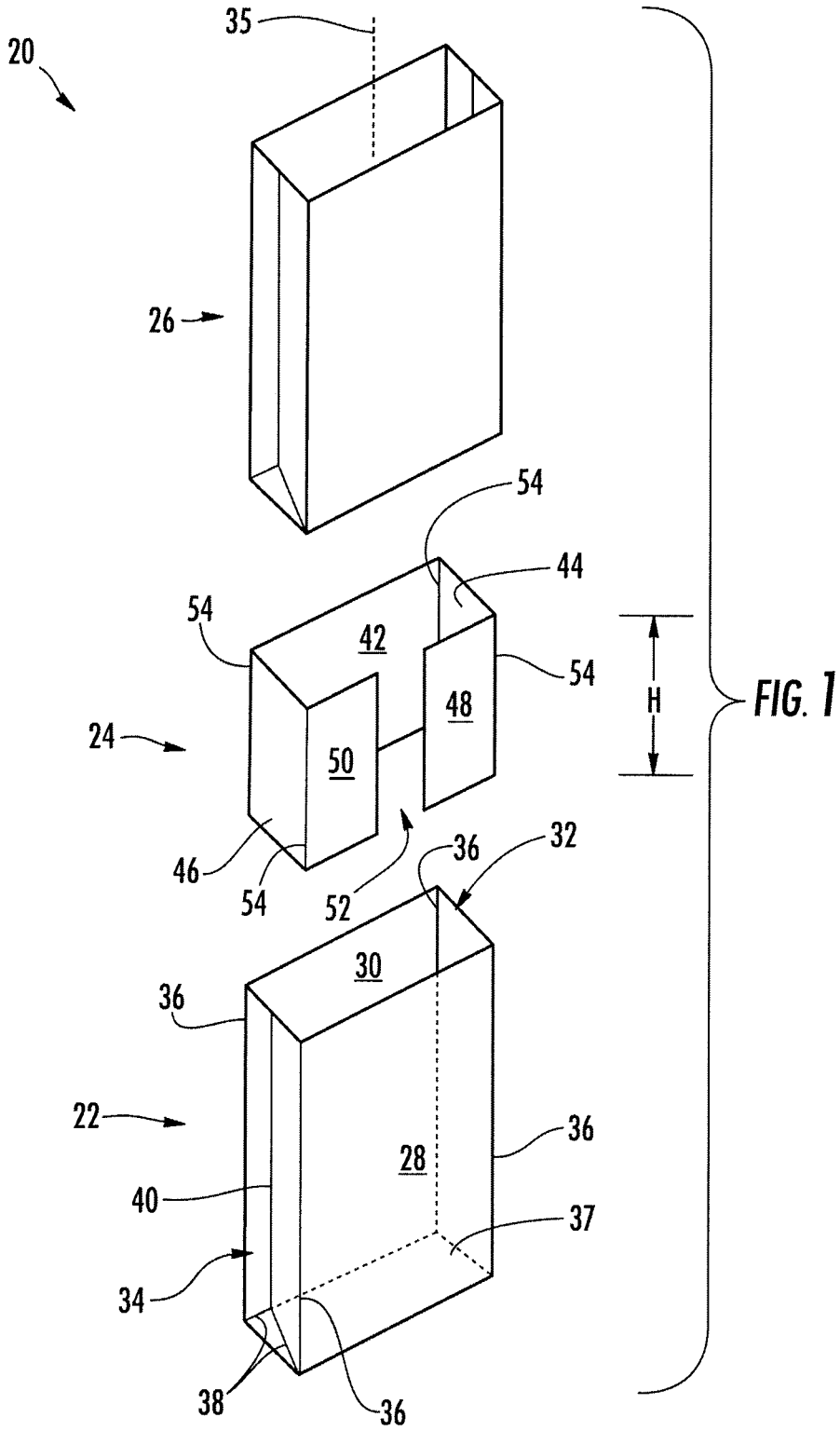
FIG. 1 is a side, front, exploded pictorial view of an upwardly open composite bag (e.g., a reinforced, multiwall bag), wherein inner and outer bags of the composite bag are in fully open configurations, and a reinforcement insert of the composite bag is in an erected configuration, in accordance with a first embodiment of this disclosure.

Referring now in greater detail to the drawings, in which like numerals refer to like parts throughout the several views, exemplary embodiments of this disclosure are described in the following. For example, FIG. 1 is a schematic exploded view of a reinforced, multiwall bag that may be referred to as a composite bag 20, in accordance with a first embodiment of this disclosure. The composite bag 20 includes an outer bag 22, an erected reinforcement 24 (e.g., reinforcing media, which may be in the form of a reinforcing insert), and optionally also an inner bag 26. The inner bag 26 is optional and may be omitted. In accordance with the first embodiment, the reinforcement 24 is constructed of flexible media (e.g., paperboard) that is thicker and stiffer than either of the inner and outer bags 22, 26 (e.g., bags comprising Kraft paper). Also, the reinforcement 24 is operatively associated with (e.g., proximate to) the outer and inner bags 26 so that the reinforcement 24 reinforces the outer and inner bags. More specifically, the reinforcement 24 reinforces predetermined portions of the outer and inner bags 22, 26, although the reinforcement may be reconfigured to reinforce substantially all of, or one or more different predetermined portions of, the outer and inner bags.

Each of the outer and inner bags 22, 26 in and of itself is of the type that is commonly referred to as a self opening sack ("SOS"), or a square or block bottom bag that has a substantially flat bottom for stability. Those of ordinary skill in the art will be able to form the conventional closed lower end of the outer and inner bags 22, 26 so that they are each in the form of an SOS or square or block bottom bag. Alternatively, different types of bags are within the scope of this disclosure (e.g., each of the outer and inner bags 22, 26 in and of itself may be any suitable type of bag). For example, the bottoms of the outer and inner bags 22, 26 may alternatively be closed in any suitable manner, such as with a pinch seal, foldover seal, and/or any other suitable seal(s), closure(s) and/or fastener (s).

The outer bag 22 includes front and rear walls 28, 30 that are connected by right and left side walls 32, 34. Longitudinal edges of the front and rear walls 28, 30 are typically connected to longitudinal edges of the side walls 32, 34 by respective longitudinal lines of disruption 36 (e.g., fold lines). The longitudinal lines of disruption 36 extend in a longitudinal direction. A portion of the right, rear line of disruption 36 is hidden from view and schematically illustrated by dashed lines in FIG. 1. The front, rear and side walls 28, 30, 32, 34 are foldably connected (e.g., by lateral lines of disruption, namely fold lines) to and extend upwardly from respective edges of a bottom wall 37 of the outer bag 22. The bottom wall 37 is hidden from view and at least partially schematically illustrated by dashed lines in FIG. 1.

The opposite bottom (e.g., bottom wall 37) and top end of the composite bag 20 are spaced apart from one another in the longitudinal direction. The interior space of the composite bag 20 is positioned between the opposite top and bottom ends of the composite bag so that the interior space has a longitudinal axis 35 that extends in the longitudinal direction. The front, rear and side walls 28, 30, 32, 34 together extend around the interior space/extend around the longitudinal axis 35 of the interior space.

Each of the side walls 32, 34 may optionally comprise/be in the form of side pleats. Each of the side walls 32, 34 may include or be formed by oblique lines of disruption 38 (e.g., fold lines) that extend divergently away from a low end of a longitudinal line of disruption 40 (e.g., fold line).

The outer bag 22 may be a single or multiwall bag constructed of any suitable flexible media, such as, but not limited to, polymer film, paper (e.g., Kraft paper and/or clay coated paper), fabric, a laminate or multi-layer (e.g., multi-ply) sheet that includes fabric, a laminate or multi-layer (e.g., multi-ply) sheet that includes polymer film, a laminate or multi-layer (e.g., multi-ply) sheet that includes paper (e.g., Kraft paper and/or clay coated paper) and one or more polymer layers (e.g., polymer film(s) or coating(s)) such that the bag may appear to be, or may be, a polymer lined paper bag, or the like. One or more layers of the outer bag 22 may be coextruded and/or otherwise joined to one another. Such layers may include polymer films, polymer or polymeric coatings or layers, paper layers, woven materials or nonwoven materials, or any other suitable material.

The inner bag 26, when it is included in the composite bag 20, may be identical to (e.g., substantially identical to) the outer bag 22. For example and perhaps depending upon the thickness of the reinforcement 24, the inner bag 26 may be substantially similar to the outer bag 22, except for the inner bag optionally being smaller than (e.g., slightly smaller than) the outer bag in a manner that seeks for the inner bag to fit neatly in the interior of the outer bag. For example, the innermost surface of the inner bag 26 may be the surface of a layer (e.g., an extrusion or coating) of polymeric material that is hydrophobic and thereby provides a degree of moisture resistance to the composite bag 20. Similarly or alternatively, the outer bag 22 or reinforcement 24 may include one or more of such moisture resistant features.

The reinforcement 24 is typically a layer (e.g., a single layer, multi-layer (e.g., multi-ply) sheet or a multilayer laminate) of material that is typically stiffer than the material from which the outer and inner bags 22, 26 are constructed. The reinforcement 24 is typically adapted and/or constructed of a material so that the reinforcement can be folded and/or bent to fit inside the outer bag 22 and reinforce the front, rear and side walls 28, 30, 32, 34 of the outer bag. The reinforcement 24 includes a rear wall 42, right and left side walls 44, 46 extending forwardly from opposite ends of the rear wall 42, and right and left front walls 48, 50 that extend toward one another from forward ends of the right and left side walls 44, 46, respectively. In accordance with the first embodiment, the free ends of the right and left front walls 48, 50 are adjacent to and spaced apart from one another so that a gap 52 is defined therebetween when the reinforcement 24 is in its final, fully erected configuration within the outer bag 22. As a result, the reinforcement 24 does not circumscribe (i.e., does not extend all the way around) the interior of the bag 20 or the longitudinal axis 35 of the interior.

The reinforcement 24 is shown in its fully erected configuration in FIG. 1. The gap 52 of the fully erected reinforcement 24 may have a width W (FIG. 2) of about 0.5 inches, at least about 0.5 inches, about 1 inch, at least about 1 inch, about 1.5 inches, at least about 1.5 inches, about 2 inches, at least about 2 inches, about 3 inches, at least about 3 inches, or any other suitable dimension. As one alternative, the right front wall 48 and/or the left front wall 50 of the reinforcement 24 may be omitted (e.g., both of the right and left front walls 48, 50 may be omitted so that the gap 52 extends all the way between the right and left side walls 44, 46). As other alternatives, the free ends of the right and left front walls 48, 50 may abut one another, may be connected (e.g., fixedly connected) to one another, or may be in an overlapping arrangement with respect to one another.

The reinforcement 24 may be erected from a flat blank (e.g., a single sheet of paperboard, or any other suitable material(s)) by folding along preformed longitudinal lines of disruption 54 (e.g., fold lines) that respectively foldably connect the walls 42, 44, 46, 48, 50 to one another. Alternatively, the reinforcement 24 may at least initially be free of the preformed longitudinal lines of disruption 54. The reinforcement 24 may be adapted and/or constructed of a resilient material so that the reinforcement is at least somewhat biased toward its flattened (e.g., flat blank) configuration and the reinforcement 24 seeks to bias at least the lower part of the composite bag 20 into an open (e.g., noncollapsed) configuration. Also, contents (e.g., product) within the composite bag 20 may push outwardly on the reinforcement 24 in a manner that biases the composite bag into the open (e.g., noncollapsed) configuration. The reinforcement 24 is typically rigid enough for seeking to maintain itself and at least the lower part of the composite bag 20 in a substantially block-like configuration (e.g., a configuration having substantially rectangular cross sections).

An example of a method of forming the composite bag 20 is described in the following, in accordance with the first embodiment. The outer bag 22 may be formed and opened in any suitable conventional manner. Then, the reinforcement 24 may be erected from a flat blank (not shown) by folding along the longitudinal lines of disruption 54. Temporarily decreasing the size of the gap 52 seeks to ease the process of erecting/inserting the reinforcement 24 into the outer bag 22. Therefore, the free ends of the right and left front walls 48, 50 may be brought proximate to one another (e.g., into contact with one another) to streamline the insertion of the reinforcement 24 through the upper opening of the outer bag 22 and into the interior of the outer bag. Then, the lower edges of the walls of the reinforcement 24 may be abutted against the interior surface of the bottom wall 37 of the outer bag 22, and the reinforcement may be released.

In accordance with the first embodiment, after the reinforcement 24 is inserted into the outer bag 22 and then released, typically the resilient and/or biased nature of the reinforcement 24 causes the reinforcement to seek to reconfiguration itself into its flat, blank-like configuration so that the gap 52 is formed between the free ends of the right and left front walls 48, 50. As the outer surfaces of the walls 42, 44, 46, 48, 50 of the reinforcement 24 come into face-to-face contact with the respective inner surfaces of the walls 28, 30, 32, 34 of the outer bag 22 due to the resilient and/or biased nature of the reinforcement, or due to the reinforcement being pushed outwardly, the outer bag arrests the movement of the reinforcement towards its flat, blank-like configuration. As a result, both the reinforcement 24 and at least the lower end of the outer bag 22 become configured in their substantially block-like configurations so that:

- substantially all of the outer surface of the right front wall 48 of the reinforcement is in opposing face-to-face contact with a lower portion of the inner surface of the front wall 28 of the outer bag 22,
- substantially all of the outer surface of the left front wall 50 of the reinforcement is in opposing face-to-face contact with a lower portion of the inner surface of the front wall 28 of the outer bag,
- substantially all of the outer surface of the rear wall 42 of the reinforcement is in opposing face-to-face contact with a lower portion of the inner surface of the rear wall 30 of the outer bag,
- substantially all of the outer surface of the right side wall 44 of the reinforcement is in opposing face-to-face contact with a lower portion of the inner surface of the right side wall 32 of the outer bag, and
- substantially all of the outer surface of the left side wall 46 of the reinforcement is in opposing face-to-face contact with a lower portion of the inner surface of the left side wall 34 of the outer bag.

If the inner bag 26 is to be included in the composite bag 20, the inner bag may be inserted through the upper opening of the outer bag 22 into both the interior of the outer bag and into the interior space that the erected reinforcement 24 extends at least partially around. The inner bag 26 is opened so that:

- substantially all of the outer surface of the bottom wall of the inner bag is in opposing face-to-face contact with the inner surface of the bottom wall 37 of the outer bag 22,
- substantially all of the inner surface of the right front wall 48 of the reinforcement is in opposing face-to-face contact with the outer surface of a lower portion of the front wall of the inner bag 26,
- substantially all of the inner surface of the left front wall 50 of the reinforcement is in opposing face-to-face contact with the outer surface of a lower portion of the front wall of the inner bag,
- substantially all of the inner surface of the rear wall 42 of the reinforcement is in opposing face-to-face contact with the outer surface of a lower portion of the rear wall of the inner bag,
- substantially all of the inner surface of the right side wall 44 of the reinforcement is in opposing face-to-face contact with outer surface of a lower portion of the right side wall of the inner bag,
- substantially all of the inner surface of the left side wall 46 of the reinforcement is in opposing face-to-face contact with the outer surface of a lower portion of the left side wall of the inner bag,
- an upper portion of the inner surface of the front wall 28 of the outer bag 22 is in opposing face-to-face relation and/or opposing face-to-face contact with the outer surface of an upper portion of the front wall of the inner bag,
- an upper portion of the inner surface of the rear wall 30 of the outer bag is in opposing face-to-face relation and/or opposing face-to-face contact with the outer surface of an upper portion of the rear wall of the inner bag, an upper portion of the inner surface of the right side wall 32 of the outer bag is in opposing face-to-face relation and/or opposing face-to-face contact with the outer surface of an upper portion of the right side wall of the inner bag, and an upper portion of the inner surface of the left side wall 34 of the outer bag is in opposing face-to-face relation and/or opposing face-to-face contact with the outer surface of an upper portion of the left side wall of the inner bag.

Alternatively, the inner bag 26 may fit more loosely within the outer bag 22 and the erected reinforcement, in which case one or more of the above-discussed opposing face-to-face contacts may be opposing face-to-face relations without face-to-face contact. Optionally, adhesive material may be applied between any one or more of the above-mentioned opposing face-to-face contacts so that the faces are fixedly connected to one another by way of the adhesive material.

Whereas the material of the reinforcement 24 is typically thicker and more rigid than the flexible media of the outer bag 22, at the same time the reinforcement 24 may be flexible or otherwise configured so that the composite bag 20 may optionally be flattened, crushed or otherwise broken down or disassembled when it is determined, for example, that the composite bag is to no longer be used. For example, the reinforcement 24 may be formed from or otherwise include any suitable material such as, but not limited to, paperboard, cardboard or polymeric sheeting. As a more specific example, the reinforcement 24 may comprises plain or laminated paperboard with a barrier film or films for providing resistance to substances such as moisture and/or grease. For example, in applications where resistance to substances such as moisture and/or grease resistance may be desired, the outer bag 22 and the reinforcement 24 may be adapted for being resistant to the substances, and the inner bag 26 may optionally be omitted. Alternatively, the inner bag 26 may be included and adapted for being resistant to the substances, in which case the outer bag 22 and the reinforcement 24 optionally may not be adapted for being resistant to the substances. For being resistant to the substances, the outer bag 22, reinforcement 24 and/or inner bag 26 may be fabricated from, or have laminated thereto or coated thereon, a barrier material, such as thin layer of polymeric material that is hydrophobic and thereby provides a degree of resistance to moisture and/or grease. Any other suitable protective measures may be used.

Figure 2:
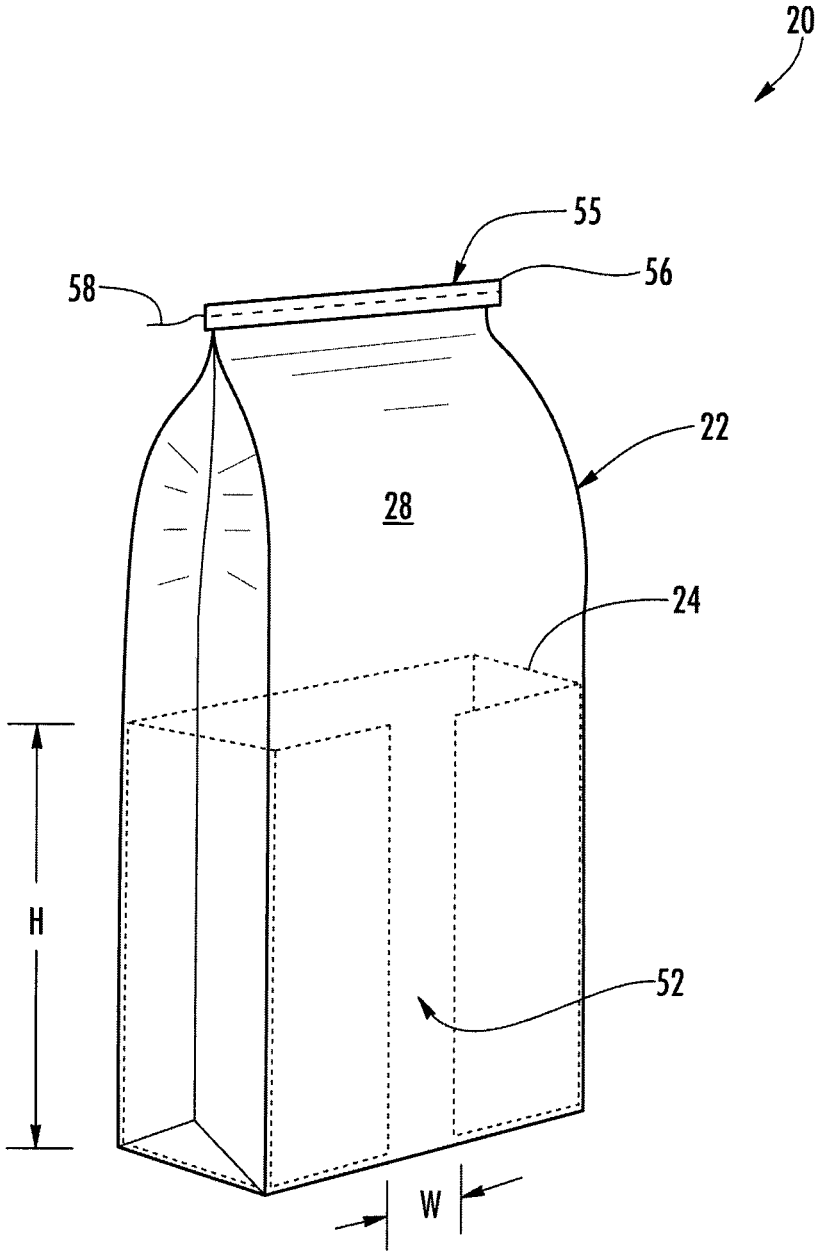
FIG. 2 is a side, front, pictorial view of the composite bag of FIG. 1 in a filled and closed configuration.

When the composite bag 20 is initially fully formed, typically the top end of the composite bag remains open. The composite bag 20 may be filled by way of its open upper end with any suitable contents, and then the top end may be closed in any suitable manner. FIG. 2 shows the composite bag 20 with the top end of the composite bag in a closed configuration. In FIG. 2, the reinforcement 24, which is hidden from view within the outer bag 22, is schematically illustrated by dashed lines. The reinforcement 24 can have a height H so that the reinforcement extends across at least approximately the bottom half of the outer bag 22. In accordance with the first embodiment and as best understood with reference to FIGS. 1 and 2, the lower edges of the walls 42, 44, 46, 48, 50 of the reinforcement 24 abut (e.g., are in opposing face-to-face contact with) the substantially flat bottom wall 37 of the outer bag 22, and the upper edges of the walls 42, 44, 46, 48, 50 of the reinforcement 24 extend to the height H above the substantially flat bottom wall of the outer bag. The reinforcement 24 reinforces the lower portion of the outer bag 22 through height H and typically maintains the substantially block-shaped configuration of the lower portion of the outer bag 22 in a manner that seeks to optimize visibility of graphics, markings, indicia or the like that are visible at the exterior of at least about the lower half of the outer bag, even when the composite bag 20 is empty or nearly empty of contents. The reinforcement 24 may be differently shaped, sized, and/or located without departing from the scope of this disclosure. For example, the reinforcement 24 may be adapted to reinforce fewer and/or different wall(s) of the bag(s) 22, 26 and/or different portions of the wall(s) of the bag(s).

The composite bag 20 may have any suitable closure mechanism for releasably maintaining the upper opening of the composite bag in the closed configuration. For example and as schematically shown in FIG. 2, at the top of the composite bag 20 the side pleats have been folded inwardly and a pinch closure has been formed by pinching at least the upper marginal portions of the front and rear walls 28, 30 of at least the outer bag 22 together. The upper marginal portions of the front and rear walls of the inner bag 26 may also be included in the pinch closure. As shown in FIG. 2, the pinch closure includes a substantially secure fastener 55 for securing the upper end of the composite bag 20 in its pinched closed configuration. The fastener 55 includes a strip 56 of material that is folded over and sewn with thread or string 58 to the pinched together upper ends of the outer and inner bags 22, 26 for securing the upper end of the composite bag 20 in its pinched closed configuration. The strip 56 may be manually grasped and pulled at least partially away from the upper end of the composite bag 20 to undo the sewing and/or otherwise cause tearing and/or breakage in a manner that opens the upper end of the composite bag so that the contents of the composite bag may be dispensed.

The upper end of the composite bag 20 may be closed in any other suitable manner, such as by an adhesive material (e.g., glue and/or a hot melt or sonically activatable adhesive material), a zipper mechanism, or other suitable closure mechanisms. For example, the top of the composite bag 20 may be closed by a foldover closure, and the foldover closure may be secured with at least one seal (e.g., the top of the composite bag may be hermetically sealed closed). The foldover closure may include a lateral line of disruption (e.g., fold line) about which the tubular upper end of the composite bag 20 is folded to form the foldover closure. The at least one seal that secures the foldover closure typically includes a foldover seal, and the at least one seal may optionally further include a pinch seal. For example, in the optional pinch seal, inner surfaces of the upper marginal portions of the front and rear walls of the inner bag 26 are sealed to one another and to the side pleats. In the foldover seal, an upper marginal portion of the front wall 28 of the outer bag 22 faces toward and is sealed to an adjacent portion of the front wall of the outer bag. The at least one seal (e.g., the pinch seal and/or the foldover seal) for maintaining the top of the composite bag 20 in the foldover configuration may be provided in any suitable manner, such as by way of a heat sealable material, adhesive material, mechanical fasteners, or otherwise. The upper end of the composite bag 20 may be closed with a pinch seal, foldover seal, and/or any other suitable seal(s), closure(s) and/or fastener(s). When it is desired to access the contents within the composite bag 20, the at least one seal, which is securing the upper end of the composite bag in its closed configuration, is typically manually undone, cut open, or opened in any other suitable manner.

As should be apparent from the foregoing, in accordance with one example of a method of assembling the composite bag 20, the outer bag 22, reinforcement 24 and inner bag 26 may be serially nested into one another. The longitudinal seams of the tubular structures from which the outer and inner bags 22, 26 were formed may be laterally offset from one another in the composite bag 20. Laterally offsetting the longitudinal seams seeks to enhance the strength of the composite bag 20.

In accordance with another example of a method of assembling the composite bag 20 and/or various other bags, the flexible media of two or more of the outer bag 22, reinforcement 24 and inner bag 26 may be configured to form a substantially flat multi-layer (e.g., multi-ply) sheet, and thereafter the composite bag may be formed from the sheet so that the two or more of the outer bag, reinforcement and inner bag are formed substantially simultaneously. For example, opposite longitudinal ends of the sheet may be connected to one another (e.g., with any suitable seal(s), such as overlap seal(s) or fin seal(s)), to form a generally tubular structure, and an end of tubular structure may be closed to form an SOS or square or block bottom bag that is like, or at least substantially like, the composite bag 20, or the end of the tubular structure may be closed in any other suitable manner. Although not explicitly shown in the figures herewith, whenever it is disclosed herein that a bag having multiple plies is formed from a multi-layer (e.g., multi-ply) sheet, or the like, there may be separate longitudinal seams (e.g., between the longitudinal edges of two or more of the layers or plies), and those longitudinal seams may be laterally offset from one another in a manner that seeks to enhance the strength of the bag. That is, the longitudinal seams between the longitudinal edges of the layers or plies may be laterally offset. Alternatively, the seams may be substantially aligned and two or more seams may optionally be combined into a single seam.

The first embodiment and a second embodiment of this disclosure are alike, except for variations noted and variations that will be apparent to one of ordinary skill in the art. Accordingly, for features of the second embodiment that are at least generally like corresponding features of the first embodiment, the reference numerals for the second embodiment are incremented by one hundred relative to the reference numerals for the first embodiment.

Figure 3:
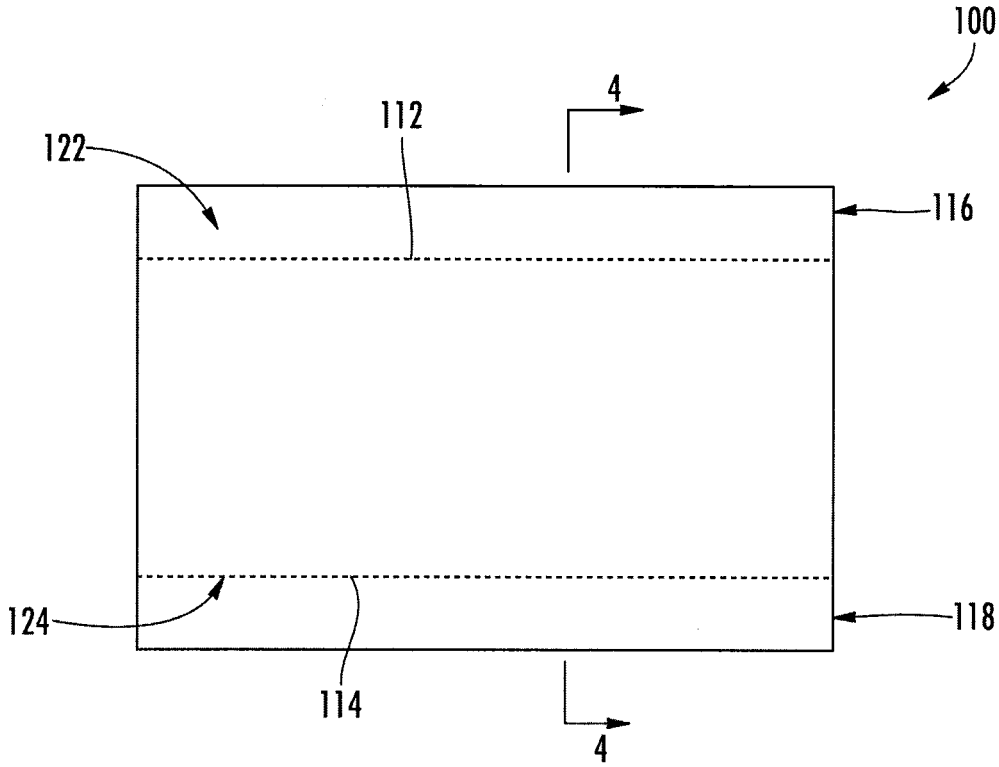
FIG. 3 is a plan view of a portion of a multi-layer (e.g., multi-ply) sheet from which a composite bag may be constructed, in accordance with a second embodiment of this disclosure.
Figure 5:
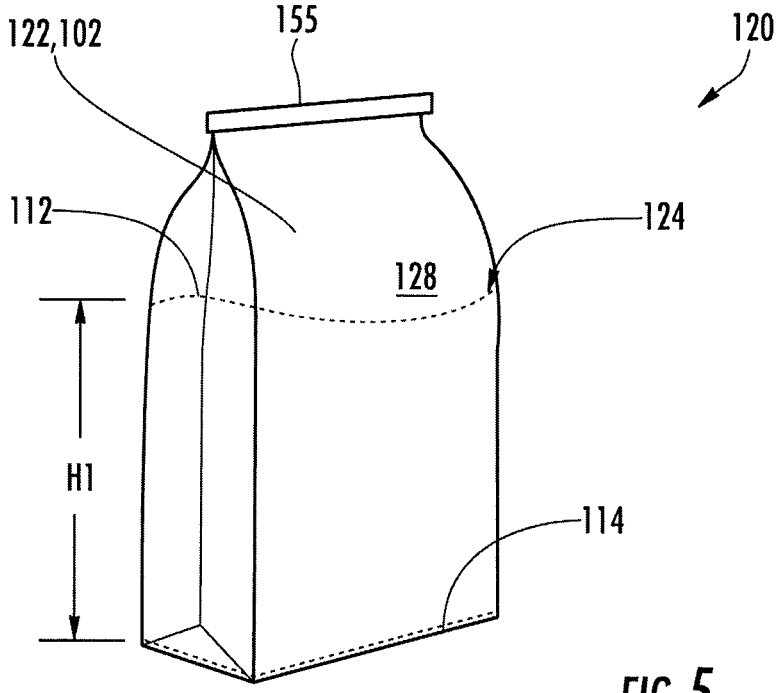
FIG. 5 is a side, front, pictorial view of a composite bag in a filled and closed configuration, in accordance with the second embodiment of this disclosure.
Figure 4:
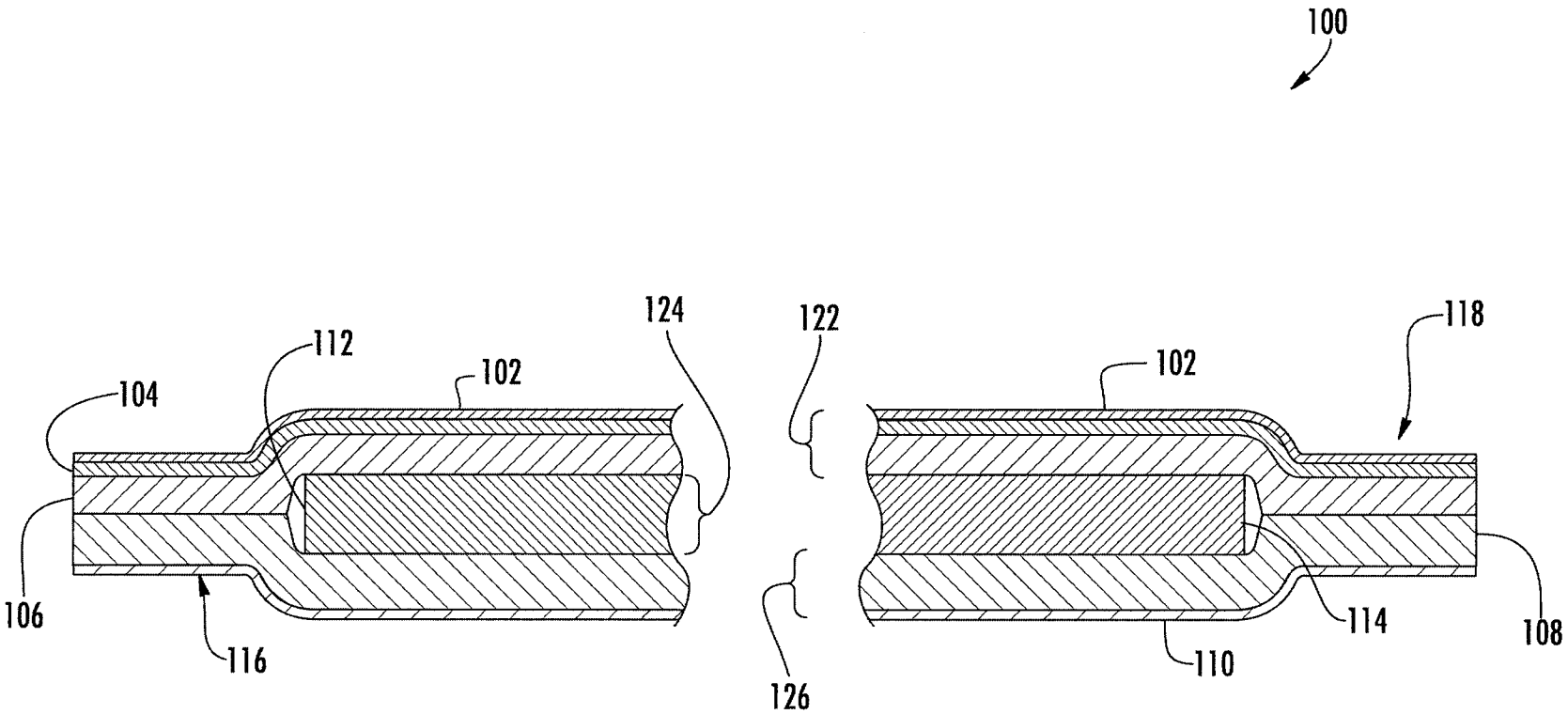
FIG. 4. is a cross-sectional view of a portion of the sheet of FIG. 3, with the cross section taken along line 4-4 of FIG. 3.

In accordance with the second embodiment, a multi-ply sheet 100 (e.g., a multi-layer sheet) schematically shown in FIGS. 3 and 4 may be used in the construction of a composite bag 120 (e.g., a multiwall bag) schematically shown in FIG. 5. Alternatively, the composite bag 120 may be constructed by a method of assembly in which an outer bag, reinforcement and optionally also an inner bag are respectively nested into one another. Throughout this disclosure, a ply may be more generally characterized as being a layer, and a layer may be characterized as being a ply.

FIG. 3 may be schematic because it is not illustrative of the fact that, for example and as alluded to above, one or more of the plies of the multi-ply sheet 100 may be laterally offset with respect to one another. As mentioned above, the plies may be laterally offset with regard to one another so that, when the tubular structure is formed from the multi-ply sheet 100, the longitudinal seams between the longitudinal edges of the plies may be laterally offset. Alternatively, the seams may be substantially aligned and they may also optionally be combined.

FIG. 4 may be schematic because, for example, it shows all of the plies of the multi-ply sheet 100 being in opposing face-to-face contact with one another. However, one or more of the adjacent plies of the multi-ply sheet 100 may not be directly joined (e.g., adhered) to one another, may be only partially joined (e.g., adhered) to one another, or may be fully joined (e.g., adhered and/or laminated) to one another. In one example, the adjacent plies of the multi-ply sheet 100 are only attached (e.g., adhered) to one another along the upper and lower marginal areas of the multi-ply sheet 100. For example, a central portion of the multi-ply sheet is cut away in FIG. 4, and there may be no direct connection between adjacent plies in that central area that is not shown in FIG. 4.

Referring to FIG. 4, layers and/or plies of the multi-ply sheet 100 may be designated as an outer layer or outer ply 122, a reinforcement layer, reinforcement sheet or reinforcement ply 124 (e.g., reinforcing media), and an inner layer, inner layers, inner ply or inner plies 126. The outer and inner plies 122, 126 may be any suitable flexible media, such as, but not limited to, those discussed above for the outer bag 22 (FIGS. 1 and 2). The reinforcement ply 124, which is typically between the outer ply 122 and the inner plies 126, may be any suitable material or materials, such as, but not limited to, those discussed above for the reinforcement 24 (FIGS. 1 and 2). For example, the reinforcement ply 124 may be a single sheet of paperboard, or any other suitable material(s). In accordance with the second embodiment, the reinforcement ply 124 may be thicker and/or stiffer than each of the outer and inner plies 122, 126. As one example, the reinforcement ply 124 may be mounted (e.g., by way of adhesive material, such as numerous spaced apart dots of adhesive material (not shown)) onto one or both of the outer and inner plies 122, 126. As a more specific example, the reinforcement ply 124 may be mounted to a single ply of Kraft paper to form a layer (e.g., wall) of the composite bag 120 (e.g., multiwall bag).

Referring in greater detail to the specific example shown in FIG. 4, the outer ply 122 may be a laminate comprising an outer layer 102 (e.g., an outer polymer layer, such as a 48 gauge layer of polyethylene terephthalate ("PET")), an intermediate layer 104 (e.g., an intermediate polymer layer, such as a 75 gauge layer of low-density polyethylene ("LDPE") extrudate), and an inner layer 106 (e.g., an inner paper layer, such as a layer of 40 pound natural Kraft paper). That is, the outer layer 102 and the intermediate layer 104 may be laminated onto or otherwise extensively fixedly connected to the inner layer 106.

The inner plies 126 of the multi-ply sheet 100 may comprise an intermediate layer or intermediate ply 108 (e.g., a paper layer, such as a layer of 40 pound natural Kraft paper), and an innermost layer or innermost ply 110 (e.g., an inner polymer layer or film, such as a 70 gauge film of bi-axially oriented polypropylene ("BOPP")). In accordance with the second embodiment, the reinforcement ply 124 (e.g., paperboard, such as, but not limited to, 16 pt paperboard) may be thicker than each of the inner layer 106 and the other plies 108, 110, 122.

The adjacent plies 108, 110, 122, 124 of the multi-ply sheet 100 may be in opposing face-to-face relation and/or contact with one another, and the adjacent plies may be joined to one another by material(s) (not shown) interposed therebetween. The adjacent layers of the multi-ply sheet 100 may be joined together in any suitable manner, such as through the use of adhesive material(s), tie layer(s) or any other suitable means. As alluded to above, any direct connection between adjacent plies is typically not too extensive, although alternatively/optionally the direct connection may be extensive. Also alternatively, the reinforcement ply 124 may be mounted (e.g., by way of adhesive material) to one or both of the layers 106 or 126 to form what may be characterized as being a middle layer or ply of the multi-ply sheet 100 and composite bag 120.

Referring to FIGS. 4 and 5, the outer layer 102 of the outer ply 122 becomes the outermost layer of the composite bag 120, and the innermost ply 110 (FIG. 4) of the inner plies 126 becomes the innermost layer of the composite bag 120. One or more layers and/or plies of the multi-ply sheet 100 and composite bag 120 may be omitted or rearranged. For example, one or both of the inner plies 126 (FIG. 4) may be omitted. As another example, the reinforcement ply 124 may adjacently between a different pair of layers or plies than shown in FIG. 4.

In FIG. 3, the reinforcement ply 124 of the multi-ply sheet 100 is hidden from view behind the outer ply 122 of the multi-ply sheet, but the top and bottom edges 112, 114 of the reinforcement ply 124 are schematically illustrated by dashed lines to show that the reinforcement ply 124 does not extend into the upper and lower marginal regions 116, 118 of the multi-ply sheet 100. Similarly, in FIG. 5, the reinforcement ply 124 is hidden from view within the outer ply 122, and the top and bottom edges 112, 114 of the reinforcement ply are schematically illustrated by dashed lines. As best understood with reference to FIG. 5, the bottom edge 144 of the reinforcement ply 124 is proximate and above the substantially flat bottom wall of the composite bag 120, and the top edge 112 of the reinforcement ply 124 extends to a height H1 above the substantially flat bottom wall of the composite bag. That is, the reinforcement ply 124 does not extend into the bottom wall or the top closure of the composite bag 120. As a result, the relatively high stiffness of the reinforcement ply 124 (as compared to the relatively less stiffness of the outer and inner plies 122, 126) seeks not to interfere with either the formation of the substantially flat bottom of the composite bag 120 or the formation of the closure at the top of the composite bag 120. The reinforcement ply 124 may be alternatively shaped, arranged, and/or located within or upon the multi-ply sheet 100 and the composite bag 120.

In accordance with the second embodiment, the composite bag 120 may be partially formed by forming a tubular structure from the multi-ply sheet 100. The tubular structure may be formed by joining opposite longitudinal edges of the multi-ply sheet 100 at longitudinal seam(s). As discussed above, the longitudinal seams between respective edges of the plies 108, 110, 114, 122 of the multi-ply sheet 100 may be laterally offset. Alternatively, the seams may be substantially aligned and they may also optionally be combined so that more that two edges are joined at a single longitudinal seam.

The lower end of tubular structure may be closed in a manner so that the composite bag 120 is an SOS or square or block bottom bag. Then, the composite bag 120 may be filled and closed with a fastener 155 or any other suitable closure, as discussed above for the composite bag 20 of the first embodiment. Different types of closures and/or seals may be incorporated into the composite bags 20, 120.

In accordance with the second embodiment, the reinforcement ply 124 of the composite bag 120 does not include a gap corresponding to the gap 52 (FIGS. 1 and 2) of the first embodiment. Rather, the longitudinally extending edges of the reinforcement ply 124 may be sealed/seamed together so that the reinforcement ply circumscribes/extends all the way around both the interior of the composite bag 120 and the longitudinal axis of the interior of the composite bag. Accordingly and as best understood with reference to FIG. 5, the reinforcement ply 124 extends laterally all the way across the front wall 128 of the composite bag 120. Other configurations are also within the scope of this disclosure. For example and alternatively, the reinforcement ply 124 may include a gap substantially or somewhat corresponding to the gap 52 (FIGS. 1 and 2) of the first embodiment, so that the reinforcement ply does not circumscribe/extend all the way around the interior/the longitudinal axis of the interior of the composite bag 120.

The second embodiment and a third embodiment of this disclosure are alike, except for variations noted and variations that will be apparent to one of ordinary skill in the art. Accordingly, for features of the third embodiment that are at least generally like corresponding features of the second embodiment, the reference numerals for the third embodiment are incremented by one hundred relative to the reference numerals for the second embodiment.

As best understood with reference to FIGS. 3, 5, 6 and 7, a difference between the second and third embodiments is that the reinforcement ply 124 is replaced with a series of reinforcement strips 224 (e.g., first, second and third reinforcements) that are respectively spaced apart from one another in the longitudinal direction. The reinforcement strips 224 (e.g., reinforcing media) of the third embodiment may be constructed similarly to the reinforcement ply 124 of the second embodiment. For example, the reinforcement strips 224 may be paperboard strips, and the paperboard strips may be mounted (e.g., by way of adhesive material) onto a single ply of Kraft paper to form a layer (e.g., wall) of the composite bag 220 (e.g., a multiwall bag). Each of the reinforcement strips 224 may be characterized as being a reinforcing sheet, a reinforcement sheet, and/or a sheet of reinforcement.

Figure 6:
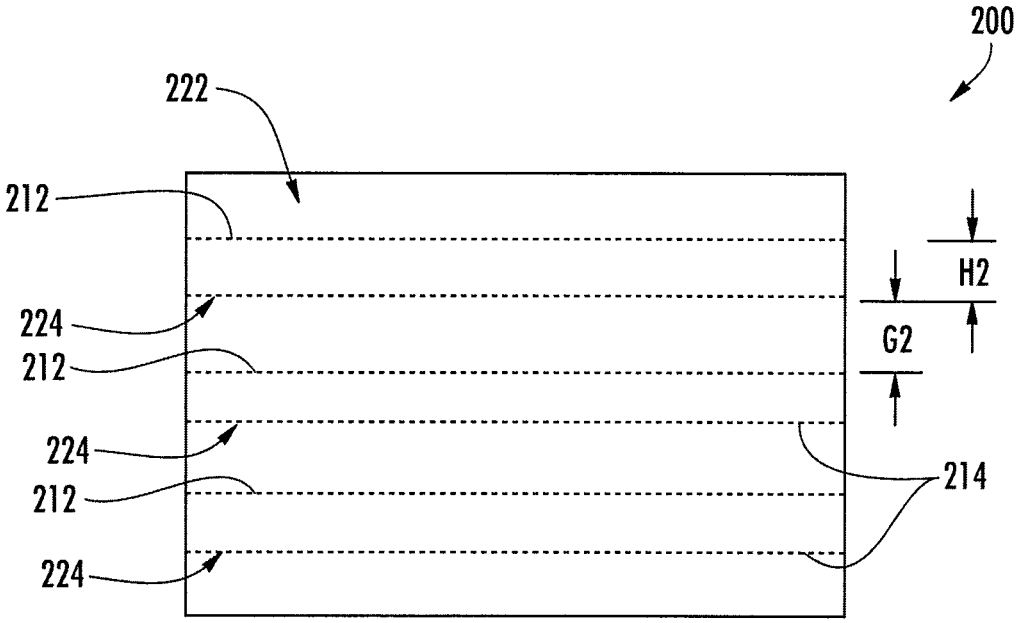
FIG. 6 is a plan view of a portion of a multi-layer (e.g., multi-ply) sheet from which a composite bag may be constructed, in accordance with a third embodiment of this disclosure.
Figure 7:
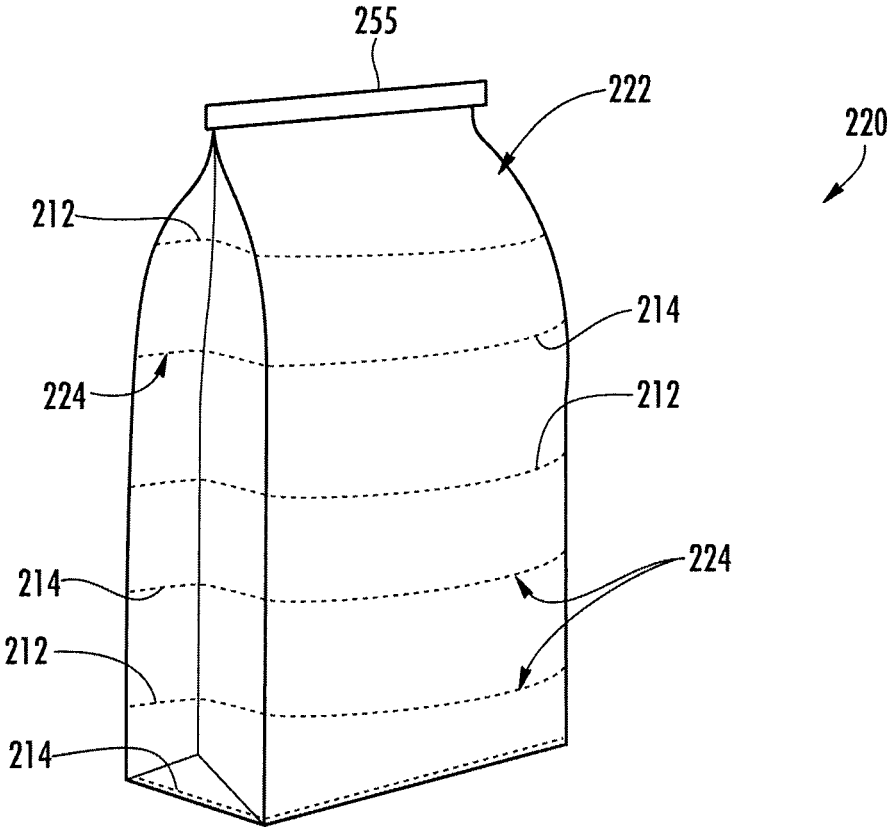
FIG. 7 is a side, front, pictorial view of a composite bag in a filled and closed configuration, in accordance with the third embodiment of this disclosure.

In FIG. 6, the reinforcement strips 224 of the multi-ply sheet 200 (e.g., a multi-layer sheet) are hidden from view behind the outer ply 222 of the multi-ply sheet. Similarly, in FIG. 7, the reinforcement strips 224 are hidden from view within the outer ply 222. In FIGS. 6 and 7, the top and bottom edges 212, 214 of each of the reinforcement strips 224 are schematically illustrated by dashed lines. Each of the reinforcement strips 224 has a height H2 (FIG. 6), and the adjacent reinforcement strips are spaced apart by a distance/gap G2 (FIG. 6). Each of the heights H2 and gaps G2 may be in a range of about 3 inches to about 4 inches. Each of the heights H2 and gaps G2 may be about 1 inch, at least about 1 inch, about 1.5 inches, at least about 1.5 inches, about 2 inches, at least about 2 inches, about 3 inches, at least about 3 inches, about 4 inches, at least about 4 inches, or any other suitable dimension. Different numbers of reinforcement strips 224 and different dimensions for the heights H2 and gaps G2 are within the scope of this disclosure.

The reinforcement strips 224 circumscribe/extend all the way around both the interior of the composite bag 220 and the longitudinal axis of the interior of the composite bag. Other configurations are also within the scope of this disclosure. For example and alternatively, one or more of the reinforcement strips 224 may include a gap substantially or somewhat corresponding to the gap 52 (FIGS. 1 and 2) of the first embodiment, so that the reinforcement strip(s) 224 do not circumscribe/extend all the way around the interior/the longitudinal axis of the interior of the composite bag 220.

FIG. 7 shows that the upper end of the composite bag 220 may be closed with the same type of fastener 255 as used for the first and second embodiments. Reiterating from above, for each of the above-discussed bags, the top and bottom ends of the bags may be closed with a pinch seal, foldover seal and/or any other suitable seal(s), closure(s) and/or fastener(s). For example and referring to FIGS. 8-10, a fourth embodiment of a composite bag 320 (e.g., a multiwall bag) has a bottom end that is closed by a bottom foldover closure 360, although the bottom of the composite bag may be closed in any other suitable way, such as, but not limited to, any of the ways discussed above.

The second embodiment and the fourth embodiment of this disclosure are alike, except for variations noted and variations that will be apparent to one of ordinary skill in the art. Accordingly, for features of the fourth embodiment that are at least generally like corresponding features of the second embodiment, the reference numerals for the fourth embodiment are incremented by two hundred relative to the reference numerals for the second embodiment.

Figure 10:
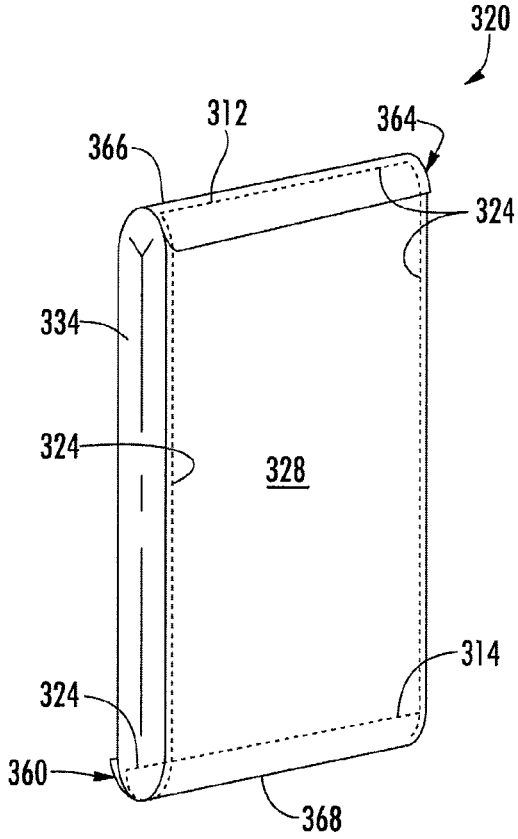
FIG. 10 is a front, left pictorial view of the composite bag of FIG. 8 a filled and closed configuration.
Figure 12:
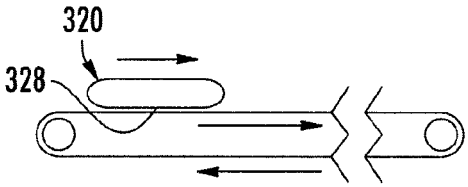
FIG. 12 illustrates the filled and closed bag of FIG. 10 being conveyed on a conveyor.

In accordance with the fourth embodiment and as best understood with reference to FIG. 10, substantially only the front wall 328, the closed bottom end of the bag 320, and optionally also the lower marginal portion of the rear wall 330 (FIG. 8) are intimately associated with and reinforced by the reinforcement ply 324 (e.g., a single sheet of paperboard, or any other suitable material(s)). More specifically, substantially all of each of the front wall 328 and the closed bottom end of the bag 320 are superposed with the reinforcement ply 324 (e.g., reinforcing media), and substantially all of the lower marginal portion of the rear wall 330 may also be superposed with the reinforcement ply 324.

Figure 9:
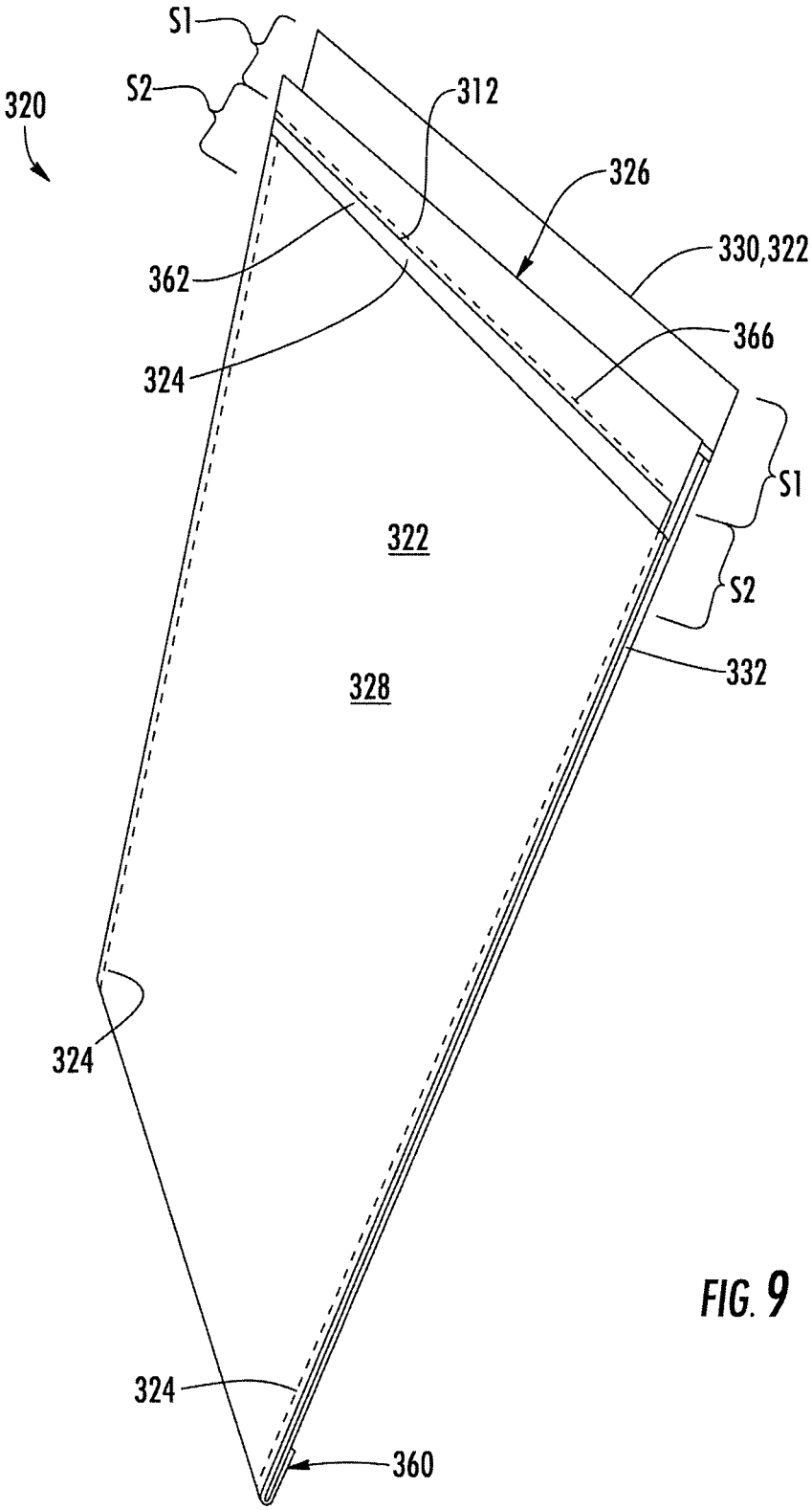
FIG. 9 is a front, right pictorial view of the composite bag of FIG. 8 an open and substantially flattened configuration.
Figure 11:
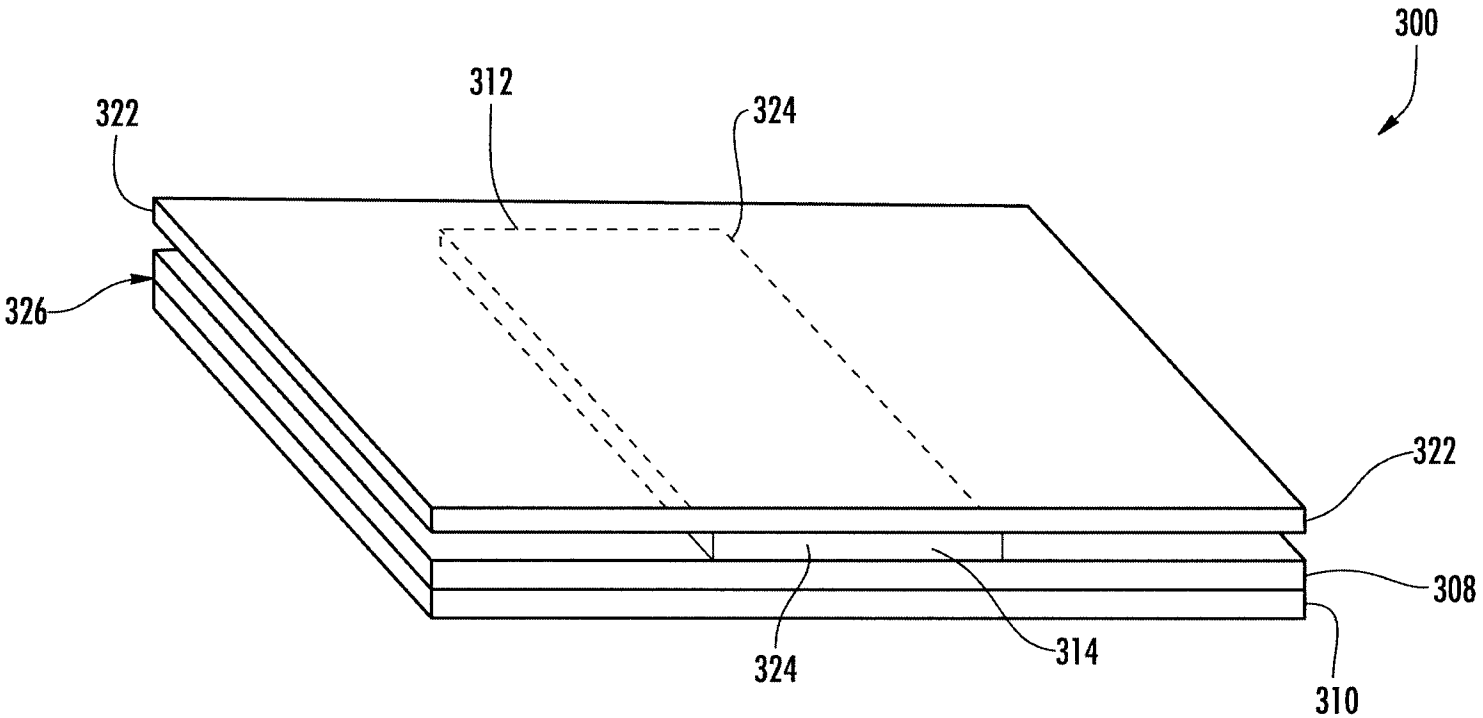
FIG. 11 is generally a bottom pictorial view that illustrates a multi-layer (e.g., multi-ply) sheet from which the composite bag of FIGS. 8-10 may be constructed, in accordance with the fourth embodiment of this disclosure.

FIG. 10 is schematic, for example, because the periphery of the reinforcement ply 324 is schematically illustrated by dashed lines since it is hidden from view within the bag 320. FIG. 9 is schematic because, for example, hidden portions of the right and left edges of the reinforcement ply 324 are illustrated by dashed lines. For example, the bag 320 may be made from a multi-ply sheet like the multi-ply sheet 100 shown in, and described with respect to, FIG. 4, except that the configuration of the reinforcement ply 324 is adjusted so that substantially only the front wall 328, the closed bottom end of the bag 320 and the lower marginal portion of the rear wall 330 are reinforced by the reinforcement ply 324. For example, FIG. 11 is a schematic (e.g., not to scale) pictorial view of a multi-ply sheet 300 (e.g., a multi-layer sheet) from which the bag 320 may be constructed. Portions of the reinforcement ply 324 that are hidden from view in FIG. 11 are schematically illustrated by dashed lines.

FIG. 11 is also schematic because, as alluded to above and in accordance with the fourth embodiment, the plies 308, 310, 322 are preferably (e.g., optionally) laterally offset with respect to one another so that when the tubular structure (from which the bag 320 is formed) is formed from the multi-ply sheet 300, the longitudinal seams between the longitudinal edges of the plies 308, 310, 322 are laterally offset. The longitudinal seams may comprise or be portions of any suitable seal(s), such as overlap seal(s) or fin seal(s). Alternatively, the seams may be substantially aligned and they may also optionally be combined.

The lower end of tubular structure may be closed in any suitable manner to form the bag 320. As will be discussed in greater detail below, the upper and lower ends of the tubular structure may include steps or staggered cuts that help to facilitate the closing of the top and bottom ends of the bag 320. FIG. 11 may also be schematic because it does not show that there are stepped or staggered cuts along the top and bottom ends of the multi-ply sheet 300, as will be discussed in greater detail below.

In the multi-ply sheet 300, the plies 308, 310, 322, 324 that are adjacent to one another may not be directly joined (e.g., adhered) to one another, may be only partially joined (e.g., adhered) to one another, or may be fully joined (e.g., adhered and/or laminated) to one another. As a more specific example, the plies 308, 310, 322, 324 that are adjacent to one another may be adhered to one another only at the lower marginal portion of the multi-ply sheet. In addition, at least some of the plies 308, 310, 322, 324 may be adhered to one another at or proximate to the upper marginal portion of the multi-ply sheet 300.

FIG. 11 generally is a bottom pictorial view; therefore, it shows that the bottom edge of the reinforcement ply 324 is aligned with or in close proximity to the bottom edge of the multi-ply sheet 300, whereas the top edge of the reinforcement ply 324 is recessed from the top edge of the multi-ply sheet 300. As a result and as best understood with reference to FIG. 10, the lower end of the reinforcement ply 324 extends at least partially into, or more specifically substantially into and across, the closed lower end of the bag 320, and the upper end of the reinforcement ply is substantially absent from the closed top end of the bag 320 when the bag is in its closed configuration shown in FIG. 10. As also shown in FIG. 10, the reinforcement ply 324 does not circumscribe the interior of the bag 320, and a gap is defined between the opposite upper and lower edges 312, 314 of the reinforcement ply 324.

Figure 8:
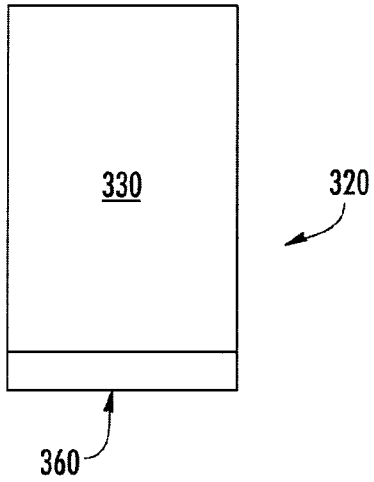
FIG. 8 is a rear elevation view of a composite bag in an open and flattened configuration, in accordance with a fourth embodiment of this disclosure.

In FIG. 9, the side pleats/side walls 332, 334 are folded inwardly and the upwardly open bag 320 is in a substantially flat configuration. Also, in FIG. 9, a majority of the reinforcement ply 324 is hidden from view behind the outer ply 322, except that an upper marginal portion 362 of the reinforcement ply is exposed because the upper end of the front wall of the bag 320 is step or staggered cut. Both the top and bottom ends of the bag 320 may include step or staggered cuts, and be closed with foldover closures 360, 364 (FIGS. 8-10). For example, closing the end of a bag having staggered cuts is disclosed in U.S. Pat. No. 6,800,051.

More specifically regarding the step or staggered cut and as best understood with reference to FIG. 9, at the upper end of the open bag 320, each of the upper edges of the entirety of the side walls 332, 334, and the entire upper edge of the inner plies 326, are substantially parallel and can be characterized as providing a first frame of reference. In the rear wall 330, the upper edge of the outer ply 322 projects upwardly beyond the first frame of reference. In the front wall 328, the upper edge 312 of the reinforcement ply 324 is recessed downwardly from the first frame of reference, and the upper edge of the outer ply 322 is recessed downwardly from the upper edge 312 of the reinforcement ply 324.

As schematically shown in FIG. 9, the upwardly open bag 320 includes marginal areas/surface areas S1, S2 that extend laterally substantially all the way between the opposite side walls 332, 334. After the bag 320 is filled with contents, the upper end of the bag is typically closed with an upper foldover closure 364 (FIG. 10) by folding the upper tubular end of the bag along an upper lateral line of disruption 366 (e.g., fold line) that is above and immediately adjacent to the upper edge 312 of the reinforcement ply 324. The upper lateral line of disruption 366 of the upper foldover closure 364 is schematically illustrated as a dashed line in FIG. 9, although the upper lateral line of disruption 366 of the upper foldover closure 364 may not be present until the upper foldover closure 364 is formed. After the upper foldover closure 364 is formed by folding approximately one hundred and eighty degrees about (e.g., at) the upper lateral line of disruption 366, the surface areas S1, S2 are in opposing face-to-face contact with one another, except that adhesive material may be positioned between the surface areas S1, S2 for forming a foldover seal, as discussed below. In accordance with the fourth embodiment, the upper lateral line of disruption 366 is not formed in the reinforcement ply 324 because the upper edge 312 of the reinforcement ply 324 is below the upper lateral line of disruption 366. Alternatively, the reinforcement ply 324 may extend further upwardly so that the upper lateral line of disruption 366 is formed in the reinforcement ply 324.

The upper foldover closure 364 is secured with at least one seal (e.g., the upper foldover closure 364 may be hermetically sealed closed). The at least one seal of the upper foldover closure 364 typically includes a foldover seal, and it may optionally further include a pinch seal. In any such pinch seal, upper marginal portions of the innermost ply 110 are sealed to one another with adhesive material or any other suitable means. As discussed above, in the foldover seal, substantially all of the surface areas S1, S2 are sealed to one another by way of adhesive material positioned between the surface areas S1, S2, or in any other suitable way. The at least one seal (e.g., the pinch seal and/or the foldover seal) for maintaining the top of the bag 320 in the foldover configuration may be provided in any suitable manner, such as by way of a heat sealable material, adhesive material, mechanical fasteners, or otherwise. The upper end of the bag 320 may be closed with a pinch seal, foldover seal, and/or any other suitable seal(s), closure(s) and/or fastener(s). When it is desired to access the contents within the bag 320, the at least one seal, which is securing the upper end of the composite bag in its closed configuration, is typically manually undone, cut open, or opened in any other suitable manner.

The lower foldover closure 360 at the lower end of the bag 320 may be formed similarly to the upper foldover closure 364 at the upper end of the bag, except that in accordance with the fourth embodiment the reinforcement ply 324 does not extend into the upper foldover closure, whereas the reinforcement ply does extend into the lower foldover closure. More specifically, the reinforcement ply 324 (e.g., paperboard sheet) is coextensive with a substantial portion of both the closed bottom end of the bag 320 and the front wall 328 of the bag, and the reinforcement ply optionally may also be coextensive with the lower marginal portion of the rear wall 330 and/or other areas of the composite bag 320.

The lower end of the multi-ply sheet 300 may be step or staggered cut before forming the bottom foldover closure 360. More specifically, at the lower end of the tubular structure from which the bag 320 is formed, each of the lower edges of the entirety of the side walls 332, 334 and the entirety of the lower edges of the inner plies 326 are substantially parallel and can be characterized as providing a second frame of reference. The lower edge 114 of the reinforcement ply 324 projects downwardly beyond the second frame of reference, and in the front wall 328, the lower edge of the outer ply 322 projects downwardly beyond the lower edge of the reinforcement ply 324. In the rear wall 338, the lower edge of the outer ply 322 is recessed upwardly from the second frame of reference.

The lower end of the bag 320 is typically closed with a lower foldover closure 360 by folding the lower end of the tubular structure along a lower lateral line of disruption 368 (e.g., fold line) that is adjacent to and lower than the lower edge of the outer ply 322 of the rear wall 338. Since the lower edge of the reinforcement ply 324 projects downwardly beyond the lower edge of the outer ply 322 of the rear wall 338, the lower lateral line of disruption 368 is typically also formed in the reinforcement ply 324, so that the reinforcement ply is included in the lower foldover closure 360 and the closed bottom end of the bag 320. The closed bottom end of the bag 320 includes the lower foldover closure 360 and the reinforcement ply 324, and the lower foldover closure 360 includes the lower lateral line of disruption 368. The lower lateral line of disruption 368 typically extends through the entire thickness of the bottom end of the bag 320, so that the reinforcement ply 324 includes the lower lateral line of disruption 368. As best understood with reference to FIGS. 10 and 11, the reinforcement ply 324 extends so far that not only is the reinforcement ply included in the lower foldover closure 360 and the bottom end of the bag 320, the reinforcement ply even extends into the rear wall 330 of the bag 320. Accordingly, the reinforcement ply 324 is cooperative with at least two of the walls 328, 330 for reinforcing the at least two walls 328, 330. Alternatively, the reinforcement ply 324 may not extend as far downwardly and may be omitted from the rear wall 330, and the reinforcement ply may also be omitted from the lower foldover closure 360, so that the reinforcement ply 324 does not include the lower lateral line of disruption 368.

Alternatively the top and bottom ends of the bag 320 may be closed in any suitable way, such as, but not limited to, any of the ways discussed above. As a more specific example, the top and bottom ends of the tube from which the bag 320 is formed may be "straight cut" (e.g., at least substantially straight cut (i.e., not step cut)), and sealed closed in any suitable way, such as, but not limited to, foldover seals (e.g., foldover seals generally like the foldover seals 360, 364, except for being formed at substantially straight cut ends). In this regard, the entire disclosure of U.S. patent application Ser. No. 12/776,507 filed May 10, 2010, is incorporated herein by reference.

In accordance with the fourth embodiment, the reinforcement ply 324 is a substantially rectangular shaped sheet or layer (e.g., of paperboard) that is configured to reinforce substantially all of both the front wall 328 and the closed bottom end of the bag 320. The reinforcement ply 324 may be positioned to also or instead reinforce the rear wall 330 of the bag 320. Also, the reinforcement ply 324 could be shaped to extend at least partially across one or more of the side walls 332, 334 of the bag 320. The reinforcement ply 324 could be placed between or inwardly of a variety of different plies of the bag 320 without departing from this disclosure. The reinforcement ply 324 could be otherwise shaped, arranged, and/or positioned without departing from the scope of this disclosure.

For example and not purposes of limiting the scope of this disclosure, FIG. 11 schematically illustrates the filled and fully closed bag 320 being conveyed on a conveyor 370 with the reinforced front wall 328 of the bag being in opposing face-to-face contact with the conveying surface (e.g., the upper surface or run of the endless belt of the conveyor).

Figure 13:
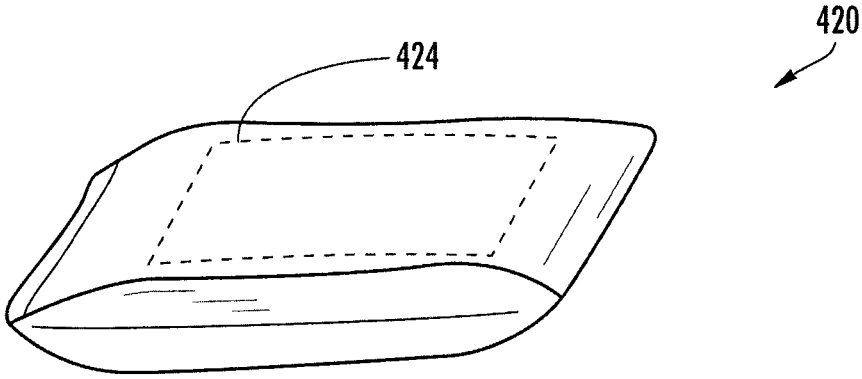
FIG. 13 is a pictorial view of a composite bag in accordance with another embodiment.
Figure 14:
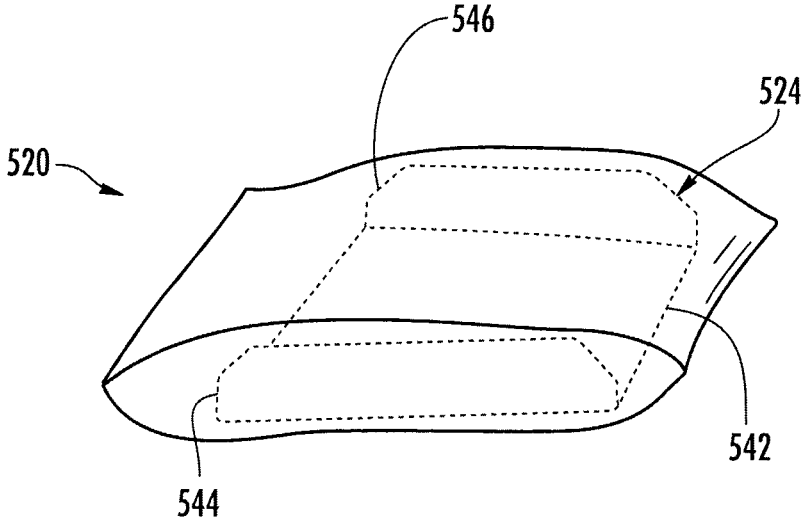
FIG. 14 is a pictorial view of a composite bag in accordance with another embodiment.

As should be apparent from the foregoing, a wide variety of bags are within the scope of this disclosure. For example, embodiments respectively shown in FIGS. 13 and 14 are like the fourth embodiment, except for variations noted and variations that will be apparent to one of ordinary skill in the art. Accordingly, for features that are at least generally alike, the reference numerals are incremented by one and two hundred, respectively, relative to the reference numerals of the fourth embodiment.

FIG. 13 illustrates a bag 420 (e.g., a multiwall bag) of another embodiment that is like the bag 320 of the fourth embodiment, except that the top and bottom ends of the reinforcement 424 (e.g., reinforcing media) are substantially recessed from each of the opposite closed ends of the bag 420. The reinforcement 424 is illustrated by dashed lines in FIG. 13 since it is hidden from view within the bag 420. The reinforcement 424 may be positioned between plies of the bag 420, or otherwise be incorporated into the bag.

In FIG. 14, the reinforcement 524 (reinforcing media) is also hidden from view within its bag 520 (e.g., a multiwall bag). The reinforcement 524 includes a front or rear wall 542, and right and left side walls 544, 546 extending forwardly from opposite ends of the front or rear wall 542. The reinforcement 524 may be inserted into the interior of the bag 520 through an open end of the bag 520, or otherwise be incorporated into the bag.

In accordance with one aspect of this disclosure, bags (e.g., the bags 120, 220, 320, 420, 520) may be constructed from sheets, by forming a substantially tubular structures from the sheets, and closing an end of the tubular structure. More specifically, the sheet may be folded or otherwise suitably arranged, and then be (typically permanently) closed along a longitudinal seam to form a substantially tubular structure.

The bottom of the substantially tubular structure is typically permanently closed to form the bag. Then, the top of the bag may be closed after contents (e.g., the product) is deposited into the interior of the bag. Any suitable longitudinal seam, and any suitable top and bottom closures may be used.

In accordance with one aspect of this disclosure, the sheets from which the tubular structures are formed may be characterized as being precursors to the tubular structures and bags. The precursors may be manufactured in any suitable manner. In one example, reinforcing layer(s) may be cut and placed on the main layer(s) or ply(s) of the precursor. If desired, the reinforcing layer(s) may be absent from one or more of the margins of the precursor, so that the desired form of seam or closure may be formed, such as by pinching, pasting, sewing, applying a hot melt, forming a heat seal, or by any other suitable means, without including the reinforcing layer(s) in the seam(s) and/or closure(s).

Prior to Making a Precursor:

- the intended use of the bag to be made from the precursor may be analyzed to determine area(s) (e.g., relatively high-stress area(s)) of the bag that may be exposed to higher stress than other area(s) (e.g., relatively low-stress area(s)) of the bag, and/or
- the manner in which the bag is intended to perform in the intended use may be analyzed to determine which reinforcing media (e.g., reinforcing layer(s)) should be selected for use based upon strength or other suitable characteristics, such as stiffness.

Then, during manufacture of the precursor, the reinforcing layer (e.g., reinforcing media, which may be one or more layers of reinforcing material) is sized and arranged, for example, so that first area(s) of the precursor include the reinforcing layer, and the reinforcing layer is absent from second area(s) of the precursor. Then, the making of the bag from the precursor may be carried out so that the relatively high-stress area(s) of the bag comprise the first area(s) of the precursor, which include the reinforcing layer, and the relatively low-stress area(s) of the bag comprise the second area (s) of the precursor, which are absent of the reinforcing layer.

The precursors of the bags (e.g., the bags 120, 220, 320, 420, 520) may be manufactured in any suitable manner, such as through relatively slow manufacturing scenarios, including manufacture by one person using simple hand tools. In contrast and in accordance with one aspect of this disclosure, precursors of the bags (e.g., the bags 120, 220, 320, 420, 520) may be manufactured through the use of high-speed cutting and laminating operations, exemplary embodiments of which are described in the following. The embodiments of this disclosure that are discussed in the following are like the above-described embodiments, except for variations noted and variations that will be apparent to one of ordinary skill in the art. Accordingly, for features that are at least generally alike, the reference numerals are varied (e.g., incremented) by hundred(s).

Figure 15:
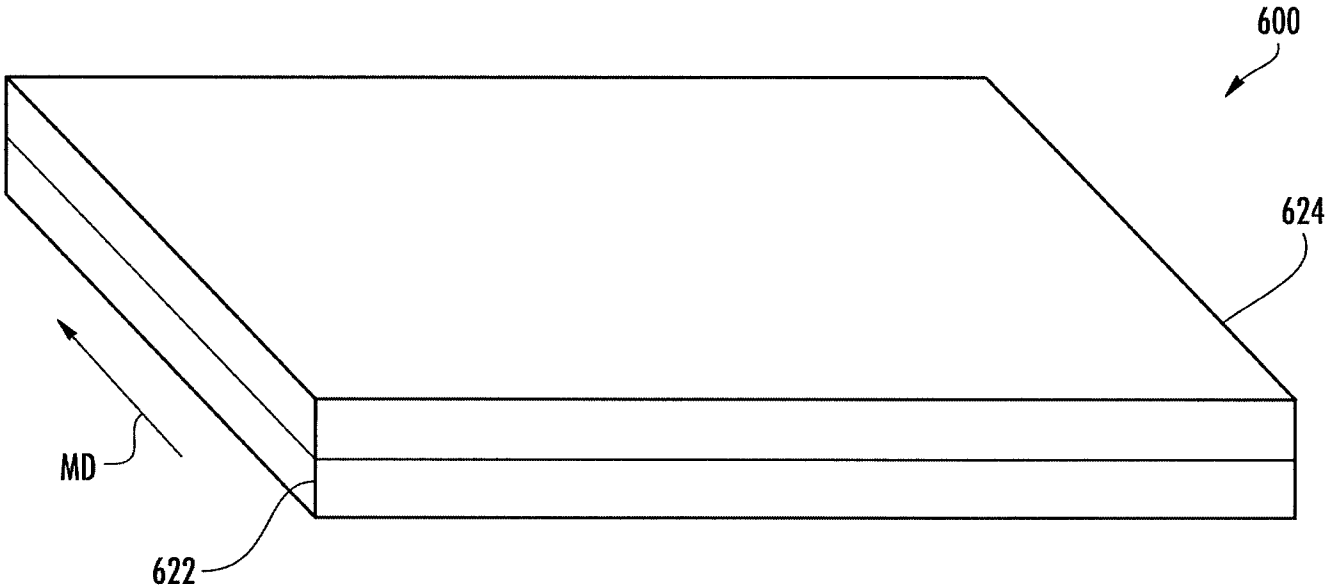
FIGS. 15-23 illustrate other sheets (e.g., precursors) from which reinforced bags may be formed, in accordance with other embodiments of this disclosure.

FIG. 15 is a schematic pictorial view of a precursor 600 (e.g., a multi-layer or multi-ply sheet) from which a bag may be constructed, in accordance with an embodiment of this disclosure. The precursor 600 includes an outer layer 622 (e.g., flexible media, which may comprise more than one layer or ply) and a reinforcing layer 624 (e.g., reinforcing media, which may comprise more than one layer or ply). The outer layer 622 typically becomes the outer layer of the bag constructed from the precursor, although different arrangements are within the scope of this disclosure.

An example of a method of manufacturing the precursor 600 through the use of high-speed cutting and laminating operations is described in the following, in accordance with an embodiment of this disclosure. In accordance with this embodiment, a first web that is the source of the outer layer 622 is unwound and drawn in the machine direction from a first roll at a first unwind station. In the Detailed Description section of this disclosure, in discussions about manufacturing through the use of high-speed cutting and laminating operations, the machine direction is a frame of reference, length typically extends in the machine direction, and width typically extends crosswise to the machine direction. The machine direction MD is schematically illustrated by an arrow in FIGS. 15-23. Typically the substantially tubular structure, from which a bag is formed, is formed by seaming together opposite edges of the precursor that extend in the machine direction MD (i.e., opposite edges that extend in the machine direction are seamed together), although a wide variety of variations are within the scope of this disclosure.

The first web that is the source of the outer layer 622 may originally be the desired final width of the precursor 600. Alternatively, the first web may be trimmed, at a first cutting station, to the desired width while the first web is drawn from the first roll. The first web that is the source of the outer layer 622 may be any suitable material, such as a single layer of heavy strong paper (e.g. 50 pound Kraft paper).

A second web that is the source of the reinforcing layer 624 is drawn/unwound from a second roll at a second unwind station. The second web that is the source of the reinforcing layer 624 may be any suitable material, such as paperboard (e.g. 16 pt paperboard). The reinforcing layer 624 is cut to the desired shape from the second web. The cutting may be carried out at a second cutting station while the second web is drawn from the second roll. The second cutting station may include an appropriately configured rotating cutting roll, or any other suitable cutting equipment.

Indexing and positioning automation equipment may be used to place the reinforcing layer 624 in the predetermined position on the outer layer 622. Prior to the placing of the reinforcing layer 624 on the outer layer 622, adhesive material may be applied in a predetermined manner to (e.g., coated onto) the reinforcing layer 624 and/or the outer layer 622 by an adhesive applicator. The reinforcing layer 624 and the outer layer 622 are pressed together and the adhesive material is dried so that the reinforcing layer 624 is fixedly connected to the outer layer 622, to form a composite web. For example, the pressing together and drying of the adhesive material may be facilitated at a hot nipping station, or in any other suitable way. The precursor 600 may be cut in the cross machine direction from the composite web at a third cutting station (e.g., a downstream cutting station).

In the bag fabricated from the precursor 600, the reinforcing layer 624 is a fully circumferential reinforcement. More specifically, the bag fabricated from the precursor 600 is fully reinforced. That is, the entire bag fabricated from the precursor 600 is reinforced by the reinforcing layer 624. Alternatively, one or more gap-like or otherwise configured portions of the reinforcing layer 624 may be omitted from the precursor 600, to provide gap-like expansion space(s), or non-reinforced area(s) in any desired location in the bag fabricated from the precursor. For example, the embodiments of FIGS. 16-19 are like the embodiment of FIG. 15, except for variations noted and variations that will be apparent to one of ordinary skill in the art.

Figure 16:
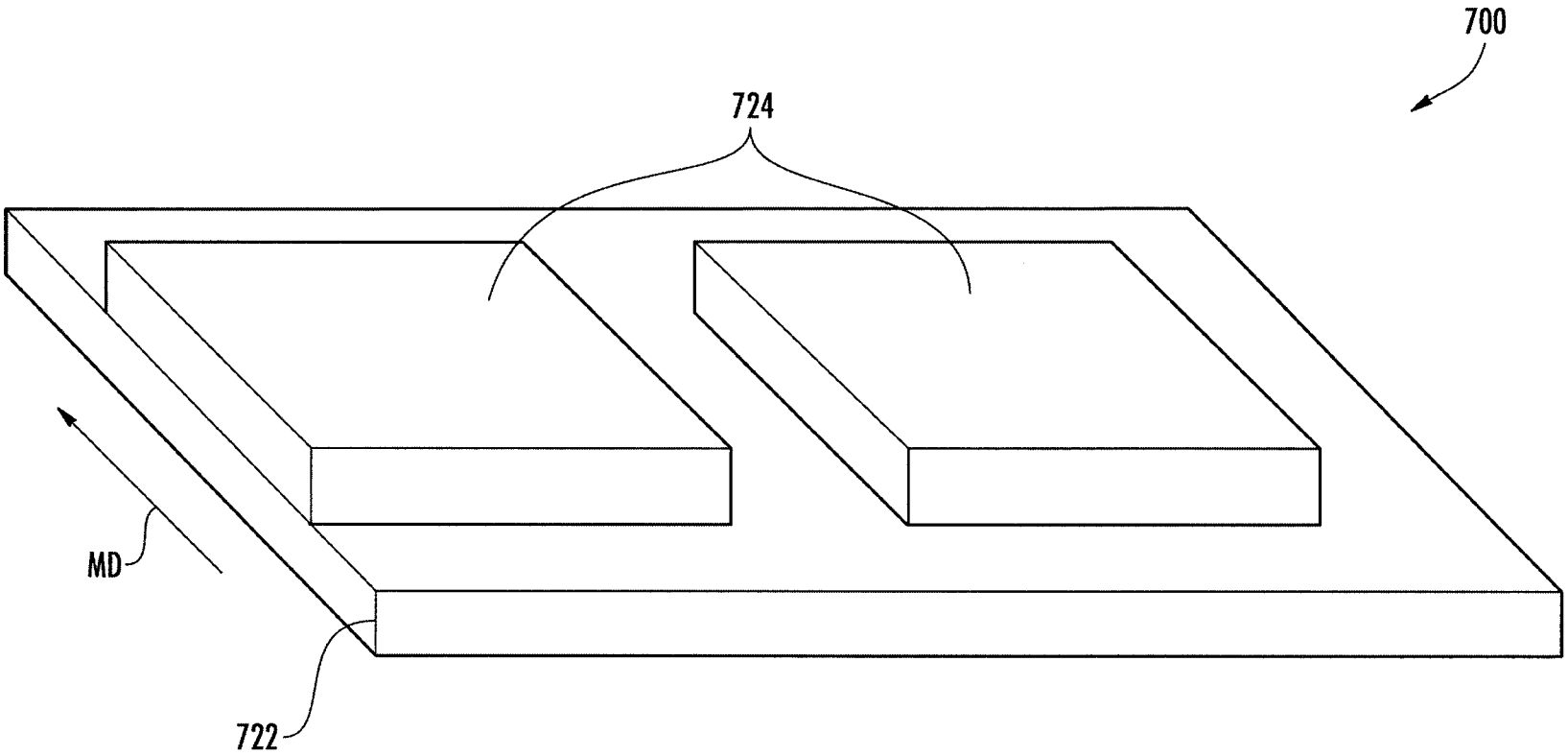

FIG. 16 is a schematic pictorial view of a precursor 700 from which a bag may be constructed. The precursor 700 includes an outer layer 722 and a reinforcing layer having two separate reinforcing pieces 724 that are spaced apart from one another. There may be more or less of the reinforcing pieces 724 of the reinforcing layer. In the bag fabricated from the precursor 700, the reinforcing pieces 724 provide both circumferential reinforcement and expansion space(s).

Figure 17:
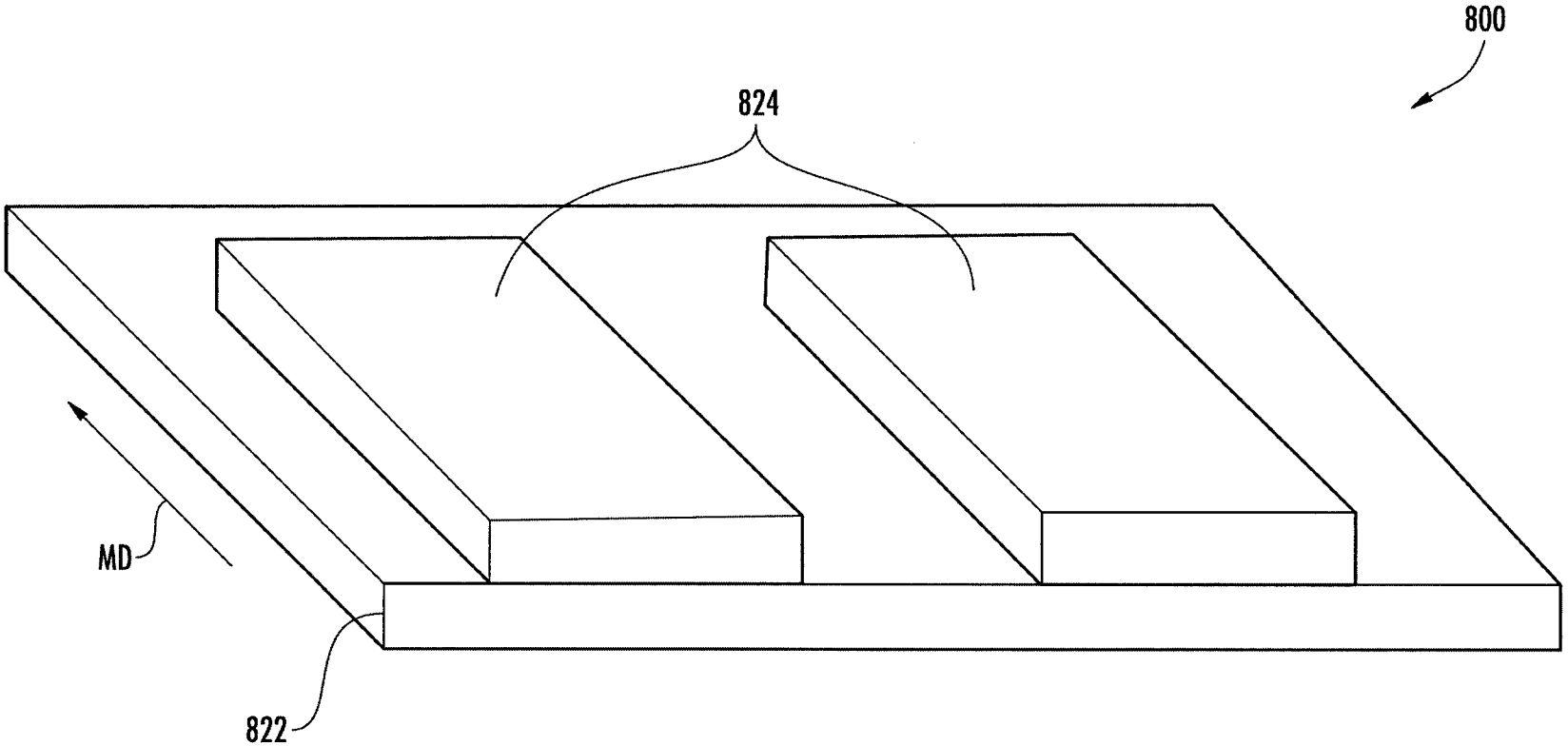

FIG. 17 is a schematic pictorial view of another precursor 800 from which a bag may be constructed. The precursor includes an outer layer 822 and a reinforcing layer having two separate reinforcing pieces 824 that are spaced apart from one another. There may be more or less of the reinforcing pieces 824 of the reinforcing layer. In the bag fabricated from the precursor 800, only the front and rear walls of the bag, and optionally also the bottom of the bag, are reinforced by the reinforcing pieces 824. For example, the sides of the bag, which may be gusseted/pleated, are typically not covered by/reinforced by the reinforcing layer.

Figure 18:
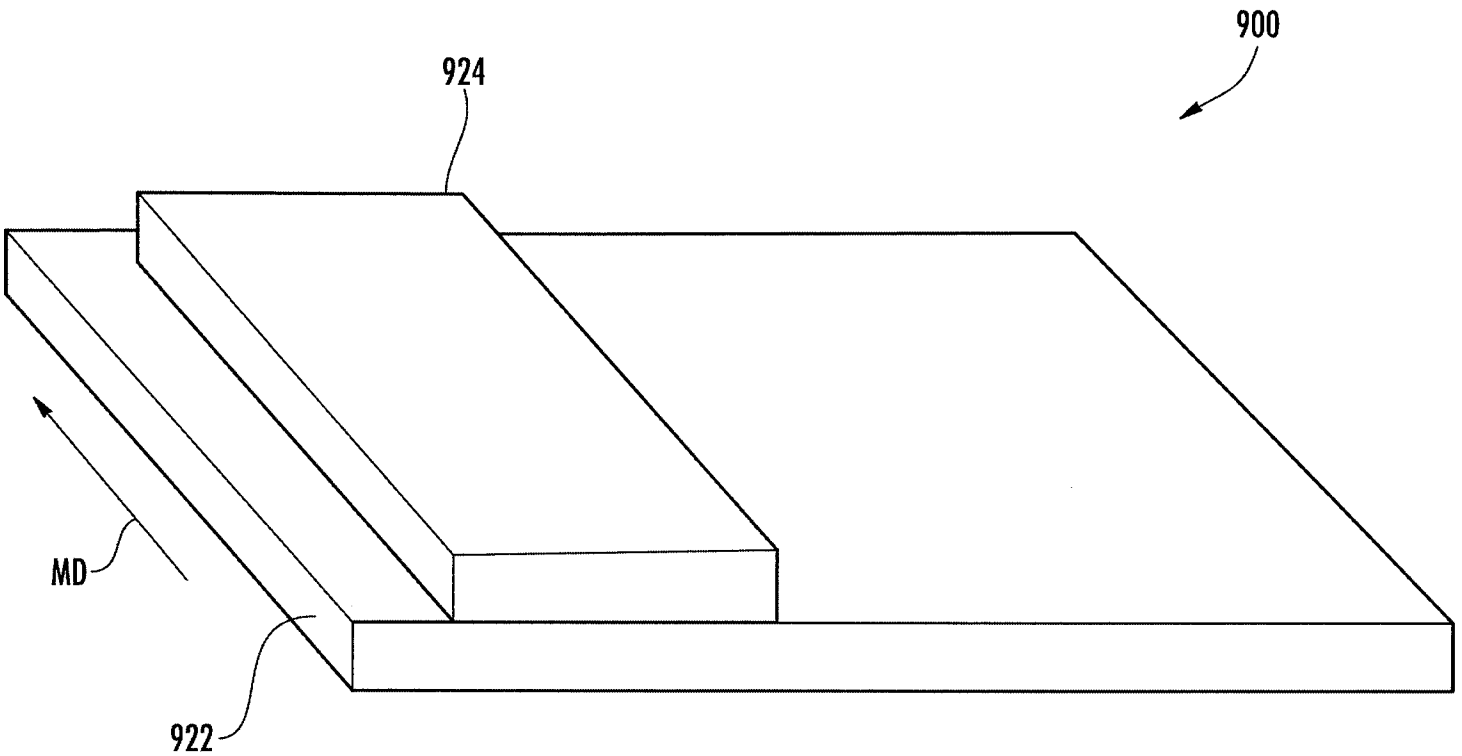

FIG. 18 is a schematic pictorial view of another precursor 900 from which a bag may be constructed. The precursor includes an outer layer 922 and a reinforcing layer having a single reinforcing piece 924. There may be more than one of the reinforcing pieces 924 of the reinforcing layer. In the bag fabricated from the precursor 900, only one of the front and rear walls of the bag, and optionally also the bottom of the bag, are reinforced by the reinforcing piece 824. That is, the reinforcing piece 924 may reinforce only one side of the bag fabricated from the precursor 900.

Figure 19:
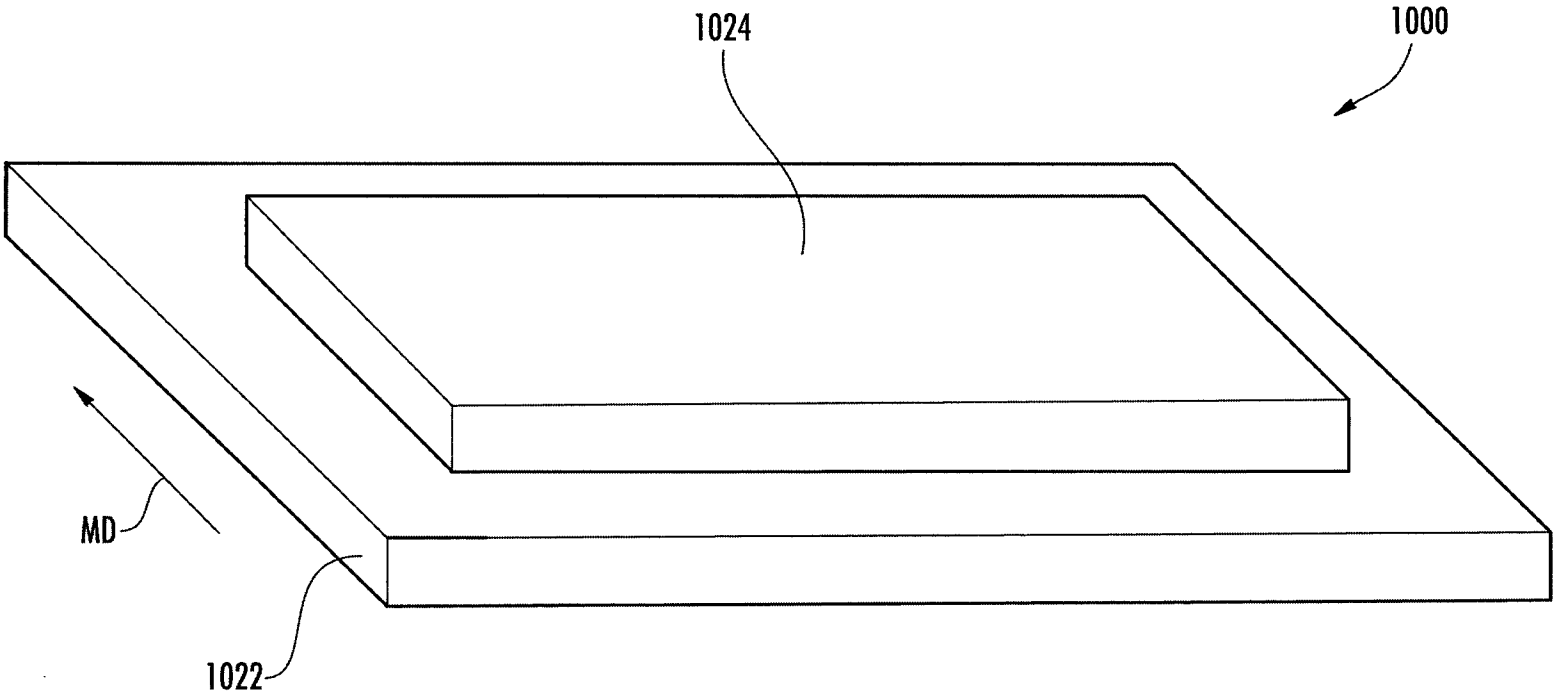

FIG. 19 is a schematic pictorial view of another precursor 1000 from which a bag may be constructed. The precursor includes an outer layer 1022 and a reinforcing layer having a single reinforcing piece 1024. There may be more than one of the reinforcing pieces 1024 of the reinforcing layer. In the bag fabricated from the precursor 1000, the reinforcing layer/reinforcing piece 1024 is absent from each of the longitudinal seal by which the precursor 1000 is formed in to a substantially tubular shape, and the top and bottom sealing areas in the bag fabricated from the precursor 1000.

A wide variety of differently configured precursors are within the scope of this disclosure. For example, in another embodiment a reinforcing piece of the reinforcing layer covers a relatively small area of the outer layer, so that the reinforcing piece provides reinforcement to a selected area where the bag formed from the precursor is subjected to a recognized area of breakage vulnerability. For example, the reinforcing piece may be in the form of a heavy duty patch that is installed to provide protection in an area which is at greater risk for puncture.

Figure 20:
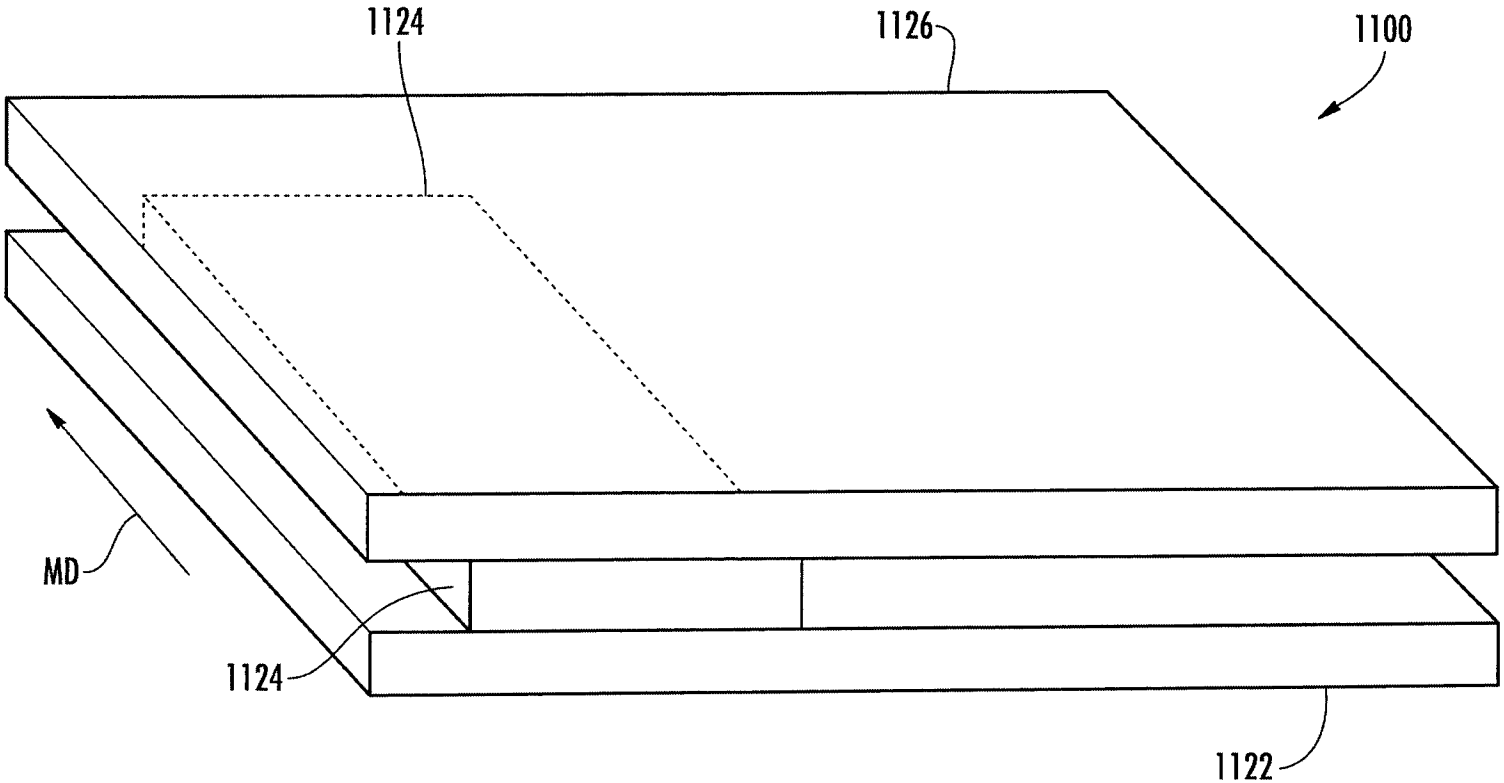

Each of the above-discussed precursors may include additional layers or plies (e.g., each reinforcing layer may be positioned between inner and outer layers), and one or more of the layers or plies of the below-discussed precursors may be omitted. For example, the embodiment of FIG. 20 is like the embodiment of FIG. 18, except for variations noted and variations that will be apparent to one of ordinary skill in the art. FIG. 20 is a schematic pictorial view of another precursor 1100 from which a bag may be constructed. The precursor 1100 includes a reinforcing layer 1124 between an outer layer 1122 and an inner layer 1126. FIG. 20 is schematic, for example, because portions of the reinforcing layer 1124 that are hidden from view are schematically illustrated by dashed lines. The inner layer 1126 typically becomes the inner layer of the bag constructed from the precursor 1100, although different arrangements are within the scope of this disclosure.

The precursor 1100 may be manufactured through high-speed cutting and laminating operations like that discussed above with respect to FIG. 15, except for variations noted and variations that will be apparent to one of ordinary skill in the art. For example, in accordance with the embodiment of FIG. 20, a third unwind station may be located downstream from the second unwind station. A third web that is the source of the inner layer 1126 is unwound and drawn in the machine direction from a third roll at the third unwind station. The third web that is the source of the inner layer 1126 may originally be the desired final width of the precursor 1100. Alternatively, the third web may be trimmed, at a third cutting station, to the desired width while the third web is drawn from the third roll. The third web that is the source of the inner layer 1126 may be any suitable material, such as a single layer of heavy strong paper (e.g. 50 pound Kraft paper).

Adhesive material may be applied in a predetermined manner to (e.g., coated onto) the reinforcing layer 1124 and/or the inner layer 1126 by another adhesive applicator. For example, the third web may be selectively printed with adhesive material so the third web will bond to (e.g., will only bond to) the reinforcing layer 1124. The reinforcing layer 1124 and the inner layer 1126 are pressed together and the adhesive material is dried so that the reinforcing layer 1124 is fixedly connected to the inner layer 1126, to complete the formation of the composite web. For example, the pressing together and drying of the adhesive material may be facilitated at a hot nipping station, or in any other suitable way. The precursor 1100 may be cut in the cross machine direction from the composite web at the downstream cutting station.

Figure 21:
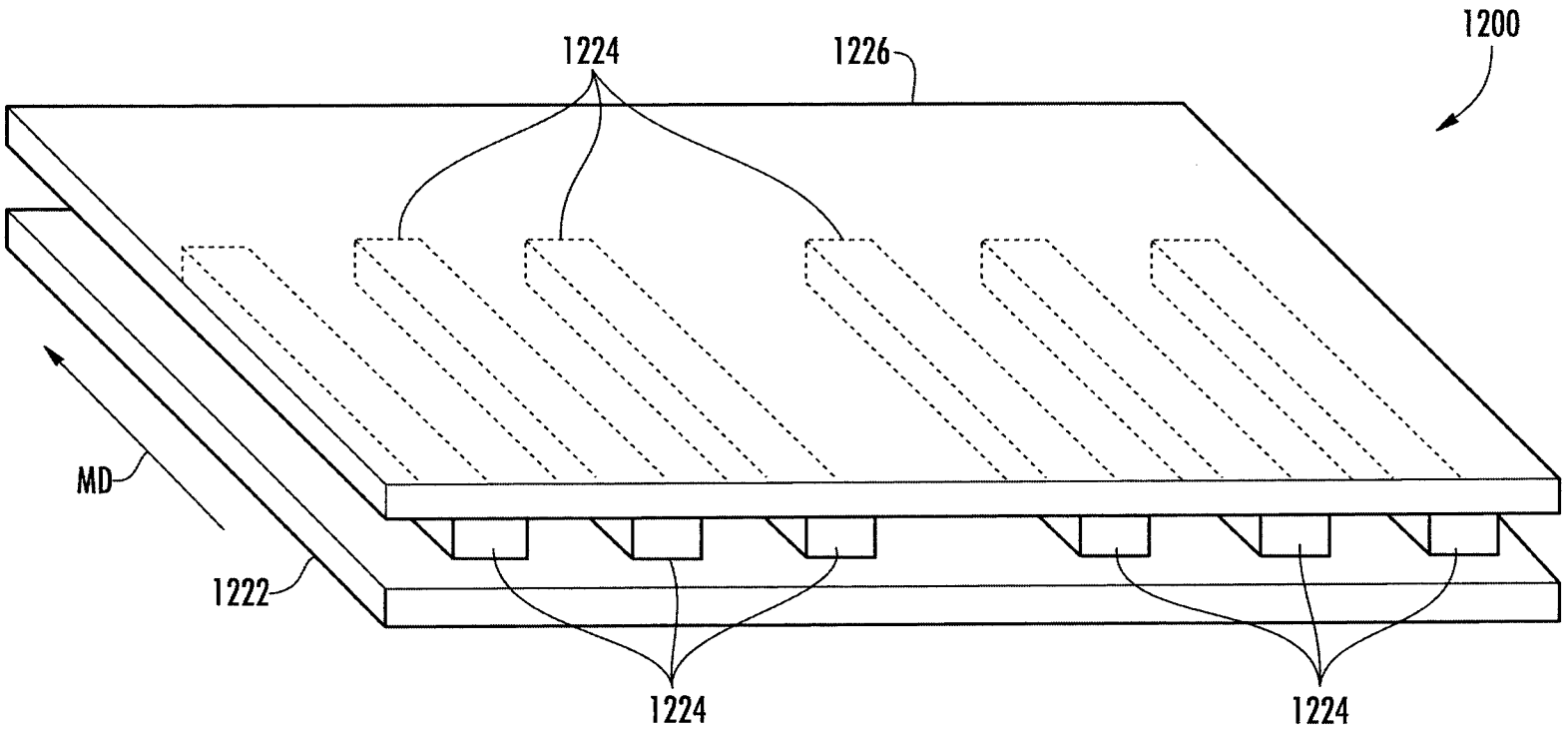

FIG. 21 is a schematic pictorial view of another precursor 1200 from which a bag may be constructed. The embodiment of FIG. 21 is like the embodiment of FIG. 20, except for variations noted and variations that will be apparent to one of ordinary skill in the art. The precursor 1200 includes a reinforcing layer between an outer layer 1222 and an inner layer 1226. The reinforcing layer is in the form of reinforcing strips 1224 that are spaced apart from one another in the cross machine direction. FIG. 21 is schematic, for example, because portions of the reinforcing strips 1224 that are hidden from view are schematically illustrated by dashed lines. For example, the reinforcing strips 1224 may be two inch wide strips, or any other suitably sized strips, that are cut from the second. The reinforcing strips 1224 may be characterized as forming spaced-apart ribs which run in the machine direction MD. A wide variety of arrangements of the ribs are within the scope of this disclosure. For example, the ribs may extend all the way across the precursor 1200, or the ribs may be arranged for reinforcing only a single side of, or a smaller portion of, the bag formed from the precursor.

Figure 22:
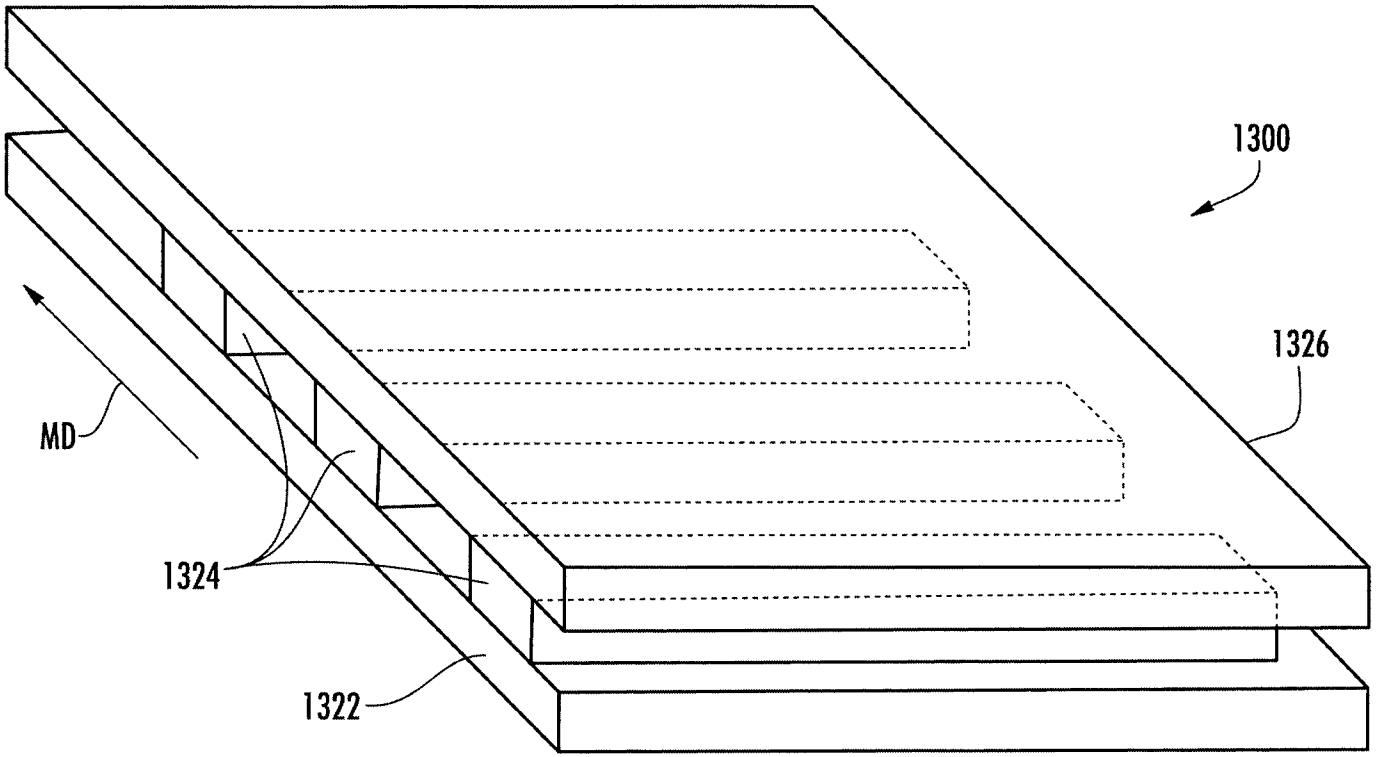

The ribs may also be configured and/or arranged differently than shown in FIG. 21. For example, the embodiment of FIG. 22 is like the embodiment of FIG. 21, except for variations noted and variations that will be apparent to one of ordinary skill in the art. FIG. 22 is a schematic pictorial view of another precursor 1300 from which a bag may be constructed. The precursor 1300 includes a reinforcing layer between an outer layer 1322 and an inner layer 1326. The reinforcing layer is in the form of reinforcing strips 1324 that are spaced apart from one another in the machine direction MD. FIG. 22 is schematic, for example, because portions of the reinforcing strips 1324 that are hidden from view are schematically illustrated by dashed lines. For example, the reinforcing strips 1324 may be two inch wide strips, or any other suitable strips, that are cut from the second web. The reinforcing strips 1324 may be characterized as forming spaced-apart ribs which run in the cross machine direction. A wide variety of arrangements of the ribs are within the scope of this disclosure. For example, the ribs may extend all the way across the precursor 1300, or the ribs may be arranged for reinforcing only a single side of, or a smaller portion of, the bag formed from the precursor.

Figure 23:
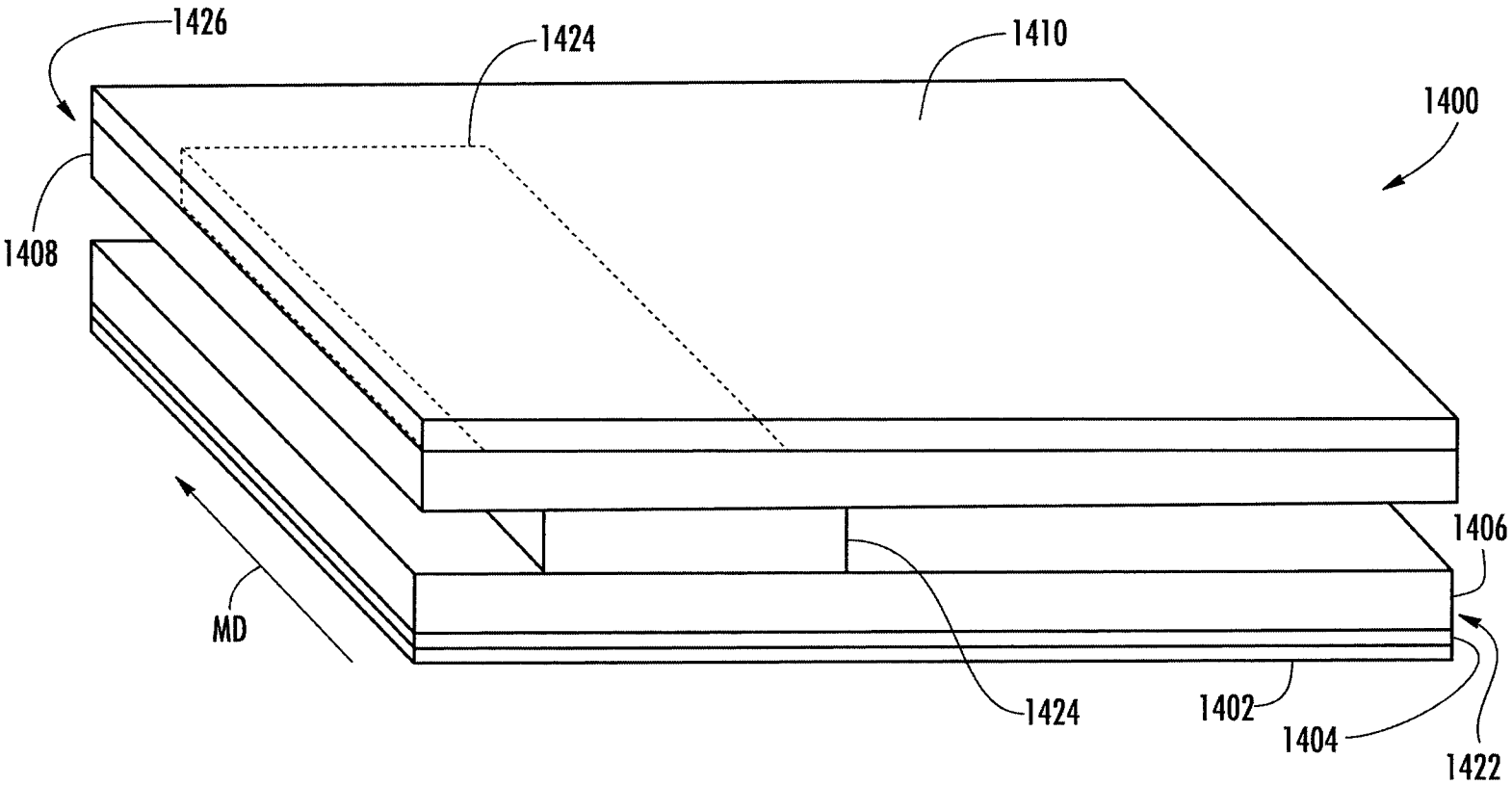

FIG. 23 is a schematic pictorial view of another precursor 1400 from which a bag may be constructed, in accordance with another embodiment of this disclosure. The embodiment of FIG. 23 is like the embodiment of FIG. 20 and the fourth embodiment of this disclosure (e.g., see FIG. 4 (inverted)), except for variations noted and variations that will be apparent to one of ordinary skill in the art. The precursor 1400 includes a composite outer layer 1422, a reinforcing layer 1424 and inner layers 1426. The reinforcing layer 1424 may be paperboard, such as, but not limited to, 16 pt paperboard.

The composite outer layer 1422 may be a laminate comprising an outer layer 1402 (e.g., an outer polymer layer, such as a 48 gauge layer of polyethylene terephthalate ("PET")), an intermediate layer 1404 (e.g., an intermediate polymer layer, such as a 75 gauge layer of low-density polyethylene ("LDPE") extrudate), and an inner layer 1406 (e.g., an inner paper layer, such as a layer of 40 pound natural Kraft paper). The outer layer 1402 and the intermediate layer 1404 may be laminated onto or otherwise extensively fixedly connected to the inner layer 1406.

The inner layers 1426 may be an intermediate layer 1408 and an innermost layer 1410. The intermediate layer 1408 may be a paper layer, such as a layer of 40 pound natural Kraft paper. The innermost layer 1410 may be an inner polymer layer or film, such as a 70 gauge film of bi-axially oriented polypropylene ("BOPP"). For example, and as best understood in view of the above discussion of the embodiment of FIG. 20, a fourth unwind station may be located downstream from the third unwind station. A fourth web that is the source of the innermost layer 1410 is unwound and drawn in the machine direction MD from a fourth roll at the fourth unwind station. The fourth web that is the source of the innermost layer 1410 may originally be the desired final width of the precursor 1400. Alternatively, the fourth web may be trimmed, at a fourth cutting station, to the desired width while the fourth web is drawn from the fourth roll.

Adhesive material may be applied in a predetermined manner to (e.g., coated onto) the innermost layer 1410 and/or the intermediate layer 1408 by another adhesive applicator. For example, the fourth web may be selectively printed with adhesive material in any suitable pattern, so the fourth web will bond to the intermediate layer 1408. The innermost layer 1410 and the intermediate layer 1408 may be pressed together and the adhesive material may be dried so that the innermost layer 1410 is fixedly connected to the intermediate layer 1408, to complete the formation of the composite web. For example, the pressing together and drying of the adhesive material may be facilitated at a hot nipping station, or in any other suitable way. The precursor 1400 may be cut in the cross machine direction from the composite web at the downstream cutting station.

As should be apparent from the foregoing, a variety of different precursors are within the scope of this disclosure. For example, figures of this disclosure may be schematic because they may not be illustrative of the fact that, for example and as alluded to above, one or more of the layers of the precursors may be laterally offset with respect to one another. As mentioned above, the layers may be laterally offset with regard to one another so that, when the tubular structure is formed from the precursor, the longitudinal seams between the longitudinal edges of the respective layers may be laterally offset. Alternatively, the seams may be substantially aligned and they may also optionally be combined. Also, one or more of the adjacent layers of the precursors may not be directly joined (e.g., adhered) to one another, may be only partially joined (e.g., adhered) to one another, or may be fully joined (e.g., adhered and/or laminated) to one another. In one example, at least some of the adjacent layers or plies of one of the precursors are only attached (e.g., adhered) to one another along the upper and lower marginal areas of the precursor.

Bags of other alternative designs could have other arrangements without departing from the scope of this disclosure. For example, the bag reinforcement structure could include reinforcement strips or panels that are selectively glued to the inner ply of the bag with some of the strips or panels being free from adhesive connection to the bag so that they can be folded to form a structural shape. The bag reinforcement structure could include locking features to hold the panels in the desired structural shape. Further, the reinforcement structure could include panels or elements that are spring-loaded so that the action of pushing the reinforcement structure into a multiwall bag would release a mechanism or position the panels or elements in a manner to allow the structure to unfold into a rectangular (or other) shape with rounded edges. Such a bag reinforcement structure could include rods of flexible material (e.g., polypropylene) and reinforcement strips (e.g., paperboard) free from adhesive attachment to the bag that could fold up and interlock with other paperboard strips to improve the stiffness of the bag. The specific materials of the reinforcement structure could be varied to adjust the desired and needed stiffness of the reinforcement structure, based on the characteristics of the bag and the product being packaged in the bag.

Any of the bags of the present disclosure can comprise any suitable material or any suitable closure mechanism. For example, the bags can comprise any of the materials or closure mechanisms disclosed in U.S. patent application Ser. No. 11/266,835, filed Nov. 4, 2005; Ser. No. 12/424,182, filed Apr. 15, 2009; and Ser. No. 12/424,188, filed Apr. 15, 2009, the entire contents of which are incorporated by reference herein. The entire disclosures of U.S. Provisional Application Nos. 61/237,446 and 61/396,115 filed Aug. 27, 2009, and May 21, 2010, respectively, are also incorporated herein by reference. The entire disclosure of U.S. Pat. No. 6,800,051 is also incorporated herein by reference.

Contents (not shown) that may be at least partially contained in the bags of this disclosure may include, but are not limited to: food products such as flour, baking mixes, corn meal, cereals, sugar, seeds or any other food product; pet products such as cat food, dog food, cat litter, or any other pet product; construction products such as cement mix, perlite, plaster and gypsum, sand and silica; or any other construction product; chemicals and fertilizers such as explosives, pesticides, pigments, plastic materials, salt, and water softeners, or any other chemical or fertilizer; minerals such as clays, drilling compound, limestone, or any other mineral; or any other suitable product of any other various type.

A fold line can be any substantially linear, although not necessarily straight, form of weakening that facilitates folding therealong. More specifically, but not for the purpose of narrowing the scope of the present disclosure, fold lines may include a line of weakening formed by folding therealong and/or a score line. A score line may be a line formed with a blunt scoring knife, or the like, which creates a crushed or depressed portion in the material along the desired line of weakness.

Directional references (e.g., upper, lower, upward, downward, left, right, leftward, rightward, top, bottom, above, below, vertical, horizontal, clockwise, counterclockwise, machine direction, upstream and downstream) have been used in this disclosure for ease of understanding and not for the purpose of limiting the scope of this disclosure. Also, in considering the scope of this disclosure, each of the features of this disclosure may be considered in isolation, and in various combinations and subcombinations.

The above examples are in no way intended to limit the scope of this disclosure. It will be understood by those skilled in the art that while the present disclosure has been discussed above with reference to exemplary embodiments, various additions, modifications and changes can be made thereto without departing from the spirit and scope of the invention as set forth in the claims.

What is claimed is:

1. A composite bag having an interior space for receiving contents, the composite bag comprising:

opposite ends that are spaced apart from one another in a longitudinal direction, wherein the interior space is positioned between the opposite ends, and the opposite ends are each closed;

a plurality of plies comprising a reinforcement ply positioned between inner and outer plies, the plurality of plies being configured to define a plurality of walls that extends around the interior space, the plurality of walls comprising opposite side walls and opposite major walls, and the major walls being larger than the side walls, wherein each of the major walls includes opposite longitudinal edges that extend in the longitudinal direction, and are spaced apart from one another in a lateral direction that extends crosswise to the longitudinal direction;

the reinforcement ply being a portion of a first wall of the major walls, wherein the reinforcement ply extends within the first wall in the longitudinal direction from proximate one of the opposite ends of the composite bag to proximate the other of the opposite ends of the composite bag, so that at least a portion of the reinforcement ply is positioned midway between the opposite ends of the composite bag, the reinforcement ply extends substantially into one of the closed ends, and is substantially absent from the other of the closed ends, and the reinforcement ply extends in the lateral direction from proximate a first of the longitudinal edges of the first wall to proximate a second of the longitudinal edges of the first wall; and the side walls not including the reinforcement ply.

2. The composite bag according to claim 1, wherein the reinforcement ply comprises a sheet of reinforcement that is more rigid than each of the inner and outer plies.

3. The composite bag according to claim 1, wherein opposite ends of the reinforcement ply are spaced apart from one another so that a gap is defined between the opposite ends of the reinforcement ply.

4. The composite bag according to claim 1, wherein the reinforcement ply is in opposing-face-to-face contact with each of the inner and outer plies.

5. The composite bag according to claim 1, wherein the reinforcement ply is substantially immediately adjacent each of the first and second longitudinal edges of the first wall.

6. The composite bag according to claim 1, wherein the reinforcement ply extends in the longitudinal direction along each of the first and second longitudinal edges of the first wall.

7. The composite bag according to claim 1, wherein:

the interior space has a longitudinal axis that extends in the longitudinal direction;

the plurality of walls extends around the longitudinal axis of the interior space; and the reinforcement ply does not completely circumscribe the longitudinal axis of the interior space.

8. The composite bag according to claim 1, wherein:

the opposite closed ends of the bag are opposite top and bottom closed ends of the bag;

the one of the closed ends is the closed bottom end of the bag, so that the reinforcement ply is coextensive with a substantial portion of the closed bottom end of the composite bag.

9. The composite bag according to claim 8, wherein:

the closed bottom end of the bag includes a foldover closure;

the foldover closure includes a lateral line of disruption in the reinforcement ply.

10. The composite bag according to claim 1, wherein:

the outer ply comprises paper, and the reinforcement ply comprises paperboard that is stiffer than the paper.

11. The composite bag according to claim 10, wherein:

the inner ply extends around a portion of the interior space, the outer ply extends around each of the interior space, the reinforcement ply and the inner ply, and the inner ply comprises paper that is less stiff than the paperboard.

12. The composite bag according to claim 1, wherein the reinforcement ply does not completely circumscribe the interior of the bag.

13. The composite bag according to claim 1, wherein the reinforcement ply is stiffer and/or thicker than each of the inner and outer plies.

14. The composite bag according to claim 1, wherein:

the reinforcement ply extends into the one of the ends so that the reinforcement ply extends at least partially around a portion of the interior space, and opposite ends of the reinforcement ply are spaced apart from one another so that a gap is defined between the opposite ends of the reinforcement ply.

15. The composite bag according to claim 1, wherein:

the reinforcement ply includes opposite ends, and an end of the opposite ends of the reinforcement ply extends at least partially into an end of the opposite ends of the composite bag.

16. The composite bag according to claim 1, wherein:

the one of the closed ends of the composite bag is a closed bottom end of the composite bag;

the first wall of the major walls is a front wall of the composite bag;

a second wall of the major walls is a rear wall of the composite bag; and the reinforcement ply extends into the a lower marginal portion of the rear wall.

17. The composite bag according to claim 16, wherein substantially only the front wall, the closed bottom end and the lower marginal portion of the rear wall include the reinforcement ply.

18. The composite bag according to claim 16, wherein the reinforcement ply spans across substantially all of each of the front wall and the closed bottom end.

19. The composite bag according to claim 18, wherein the reinforcement ply spans across substantially all of the lower marginal portion of the rear wall.

20. The composite bag according to claim 1, wherein a top end of the opposite ends of the composite bag is step cut so that a top edge of the reinforcement ply is recessed from each of:

the top end of the composite bag;

a top edge of the outer ply; and a top edge of the inner ply.

21. The composite bag according to claim 1, wherein an end of the reinforcement ply extends into and across the one of the closed ends of the composite bag.

22. The composite bag according to claim 1, wherein a top end of the opposite ends of the composite bag is step cut so that:

upper edges of the side walls and an upper edge of the inner ply are substantially parallel with one another;

an upper edge of the outer ply of a rear wall of the major walls projects upwardly beyond the upper edges of the side walls and the upper edge of the inner ply;

an upper edge of the reinforcement ply is recessed downwardly from the upper edges of the side walls and the upper edge of the inner ply; and an upper edge of the outer ply of a front wall of the major walls is recessed downwardly from the upper edge of the reinforcement ply.

23. A composite bag having an interior space for receiving contents, the composite bag comprising:

opposite ends that are spaced apart from one another in a longitudinal direction, wherein the interior space is positioned between the opposite ends;

a plurality of plies comprising a reinforcement ply positioned between inner and outer plies, the plurality of plies being configured to define a plurality of walls that extends around the interior space, the plurality of walls comprising opposite side walls and opposite major walls, and the major walls being larger than the side walls, wherein each of the major walls includes opposite longitudinal edges that extend in the longitudinal direction, and are spaced apart from one another in a lateral direction that extends crosswise to the longitudinal direction;

the reinforcement ply being a portion of a first wall of the major walls, wherein the reinforcement ply extends within the first wall in the longitudinal direction from proximate one of the opposite ends of the composite bag to proximate the other of the opposite ends of the composite bag, so that at least a portion of the reinforcement ply is positioned midway between the opposite ends of the composite bag, and the reinforcement ply extends in the lateral direction from proximate a first of the longitudinal edges of the first wall to proximate a second of the longitudinal edges of the first wall; and the side walls not including the reinforcement ply, wherein the opposite ends of the bag are opposite top and bottom ends of the bag, the bottom end of the bag is closed, the reinforcement ply is coextensive with a substantial portion of the closed bottom end of the composite bag, the top end of the bag is closed, and the reinforcement ply is substantially absent from the closed top end of the bag.

24. A composite bag having an interior space for receiving contents, the composite bag comprising:

opposite ends that are spaced apart from one another in a longitudinal direction, wherein the interior space is positioned between the opposite ends;

a plurality of plies comprising a reinforcement ply positioned between inner and outer plies, the plurality of plies being configured to define a plurality of walls that extends around the interior space, the plurality of walls comprising opposite side walls and opposite major walls, and the major walls being larger than the side walls, wherein each of the major walls includes opposite longitudinal edges that extend in the longitudinal direction, and are spaced apart from one another in a lateral direction that extends crosswise to the longitudinal direction;

the reinforcement ply being a portion of a first wall of the major walls, wherein the reinforcement ply extends within the first wall in the longitudinal direction from proximate one of the opposite ends of the composite bag to proximate the other of the opposite ends of the composite bag, so that at least a portion of the reinforcement ply is positioned midway between the opposite ends of the composite bag, and the reinforcement ply extends in the lateral direction from proximate a first of the longitudinal edges of the first wall to proximate a second of the longitudinal edges of the first wall; and the side walls not including the reinforcement ply, wherein each of the opposite ends of the composite bag are closed, an end of the reinforcement ply extends into and across one of the closed ends of the composite bag, and the reinforcement ply is substantially absent from the other closed end of the composite bag.

25. A composite bag having an interior space for receiving contents, the composite bag comprising:

opposite ends that are spaced apart from one another in a longitudinal direction, wherein the interior space is positioned between the opposite ends;

a plurality of plies comprising a reinforcement ply positioned between inner and outer plies, the plurality of plies being configured to define a plurality of walls that extends around the interior space, the plurality of walls comprising opposite side walls and opposite major walls, and the major walls being larger than the side walls, wherein each of the major walls includes opposite longitudinal edges that extend in the longitudinal direction, and are spaced apart from one another in a lateral direction that extends crosswise to the longitudinal direction;

the reinforcement ply being a portion of a first wall of the major walls, wherein the reinforcement ply extends within the first wall in the longitudinal direction from proximate one of the opposite ends of the composite bag to proximate the other of the opposite ends of the composite bag, so that at least a portion of the reinforcement ply is positioned midway between the opposite ends of the composite bag, and the reinforcement ply extends in the lateral direction from proximate a first of the longitudinal edges of the first wall to proximate a second of the longitudinal edges of the first wall; and the side walls not including the reinforcement ply, wherein a top end of the opposite ends of the composite bag is step cut so that upper edges of the side walls and an upper edge of the inner ply are substantially parallel with one another, an upper edge the outer ply of a rear wall of the major walls projects upwardly beyond the upper edges of the side walls and the upper edge of the inner ply, an upper edge of the reinforcement ply is recessed downwardly from the upper edges of the side walls and the upper edge of the inner ply, and an upper edge of the outer ply of a front wall of the major walls is recessed downwardly from the upper edge of the reinforcement ply, and wherein marginal portions of each of the side walls, the inner ply and the outer ply of the rear wall are folded over the upper edge of the reinforcement ply.

26. A composite bag having an interior space for receiving contents, the composite bag comprising:

opposite top and bottom ends that are spaced apart from one another in a longitudinal direction, wherein the interior space is positioned between the opposite ends;

a plurality of plies comprising a reinforcement ply positioned between inner and outer plies, the reinforcement ply being stiffer than each of the inner and outer plies, the plurality of plies being configured to define a plurality of walls that extends around the interior space, the plurality of walls comprising opposite side walls and opposite front and rear walls, and the front and rear walls being larger than the side walls, wherein the front wall includes opposite longitudinal edges that extend in the longitudinal direction, and are spaced apart from one another in a lateral direction that extends crosswise to the longitudinal direction;

the reinforcement ply being a portion of the front wall, the reinforcement ply extending in the longitudinal direction from proximate the top end to proximate the bottom end, so that at least a portion of the reinforcement ply is positioned midway between the top and bottom ends of the composite bag, and the reinforcement ply extending in the lateral direction from proximate a first of the longitudinal edges of the front wall to proximate a second of the longitudinal edges of the front wall; and the top end being step cut so that upper edges of the side walls and an upper edge of the inner ply are substantially parallel with one another, an upper edge the outer ply of the rear wall projects upwardly beyond the upper edges of the side walls and the upper edge of the inner ply, an upper edge of the reinforcement ply is recessed downwardly from the upper edges of the side walls and the upper edge of the inner ply, and an upper edge of the outer ply of the front wall is recessed downwardly from the upper edge of the reinforcement ply, wherein marginal portions of each of the side walls, the inner ply and the outer ply of the rear wall are folded over the upper edge of the reinforcement ply.

27. The composite bag according to claim 26, wherein the side walls do not include the reinforcement ply.

* * * * *